US012239244B1

(12) United States Patent
Bickel et al.

(10) Patent No.: US 12,239,244 B1
(45) Date of Patent: Mar. 4, 2025

(54) COLLAPSIBLE BASSINET APPARATUS

(71) Applicant: Regalo International, LLC, Burnsville, MN (US)

(72) Inventors: Shannon R. Bickel, Lakeville, MN (US); William D. Butterfield, River Falls, WI (US); Heidi C. Leighton, Shorewood, MN (US)

(73) Assignee: Regalo International, LLC, Burnsville, MN (US)

( * ) Notice: Subject to any disclaimer, the term of this patent is extended or adjusted under 35 U.S.C. 154(b) by 0 days.

(21) Appl. No.: 17/327,712

(22) Filed: May 22, 2021

Related U.S. Application Data

(60) Provisional application No. 63/173,986, filed on Apr. 12, 2021.

(51) Int. Cl.
*A47D 9/00* (2006.01)

(52) U.S. Cl.
CPC ..... *A47D 9/005* (2013.01)

(58) Field of Classification Search
CPC . A47D 9/00; A47D 9/005; A47D 7/00; A47D 7/002
See application file for complete search history.

(56) References Cited

U.S. PATENT DOCUMENTS 1,950,603 A * 3/1934 Fischer ..... A47D 13/065 256/25
3,838,883 A * 10/1974 Machen ..... A47D 7/002 297/16.2
4,739,527 A * 4/1988 Kohus ..... A47D 13/066 5/99.1
5,115,524 A * 5/1992 Antosko ..... A47D 9/005 229/117.17
6,134,727 A * 10/2000 Hwang ..... A47C 17/64 5/112
6,421,850 B1 * 7/2002 Welsh, Jr. ..... A47D 13/063 5/98.1
6,438,773 B1 * 8/2002 Hsia ..... A47D 13/063 5/98.1
6,588,033 B1 * 7/2003 Welsh, Jr. ..... A47D 7/002 5/98.1
6,925,664 B1 * 8/2005 Twigg ..... A01K 1/034 5/112
7,114,205 B2 * 10/2006 Choi ..... A47C 19/14 5/115
7,617,550 B2 * 11/2009 Gehr ..... A47D 13/063 5/99.1
7,712,163 B2 * 5/2010 Flannery ..... A47C 17/74 5/115
7,950,083 B2 5/2011 Flannery
8,162,349 B1 * 4/2012 Roselle ..... B62B 5/085 280/654
10,871,007 B1 * 12/2020 Tsai ..... E04H 15/50
(Continued)

*Primary Examiner* — George Sun

(57) ABSTRACT

A bassinet apparatus having a scissoring leg arrangement with upper and lower hubs, a flexible receptacle, and posts engaged with the upper hubs, the lower hubs, and flexible receptacle. The flexible receptacle includes an endless flexible sidewall and a flexible floor. The posts slidingly engage each of the endless flexible sidewall and the flexible floor such that the flexible receptacle can be compressed longitudinally and laterally into a compact form when the scissoring leg arrangement is folded in to a compact form.

19 Claims, 14 Drawing Sheets

(56) References Cited

U.S. PATENT DOCUMENTS

| | | | | |
|---|---|---|---|---|
| 11,266,253 | B1 * | 3/2022 | Flannery | A47D 9/00 |
| 2003/0024660 | A1 * | 2/2003 | Homeyer | A47D 7/002 160/377 |
| 2007/0289060 | A1 * | 12/2007 | Berkey | A47D 9/016 5/98.1 |
| 2011/0283457 | A1 * | 11/2011 | Son | A47D 9/016 5/690 |
| 2012/0311782 | A1 * | 12/2012 | Tricault | A47D 7/002 5/99.1 |
| 2014/0208505 | A1 * | 7/2014 | Burkholder | A47D 7/002 5/99.1 |
| 2016/0000234 | A1 * | 1/2016 | Whitman | A47D 13/061 5/99.1 |
| 2016/0309913 | A1 * | 10/2016 | Peterson | A47D 15/003 |
| 2016/0309914 | A1 * | 10/2016 | Burns | A47D 9/005 |
| 2018/0192783 | A1 * | 7/2018 | Henry | A47D 7/002 |
| 2019/0335702 | A1 * | 11/2019 | Thrift | E04H 15/48 |
| 2020/0352352 | A1 * | 11/2020 | Fusco | A47D 13/061 |
| 2021/0137280 | A1 * | 5/2021 | Villano | A47D 15/008 |

* cited by examiner

COLLAPSIBLE BASSINET APPARATUS

This application claims the benefit under 35 U.S.C. 119 (e) of U.S. Provisional Patent Application No. 63/173,986 filed Apr. 12, 2021, which application is hereby incorporated by reference in its entirety into this application.

FIELD OF THE INVENTION

The present invention relates to a bassinet apparatus, particularly to a bassinet apparatus having a scissoring leg arrangement, and specifically to a bassinet apparatus having a scissoring leg arrangement mounting a flexible bassinet that folds in and out when the scissoring leg arrangement folds in and out.

BACKGROUND OF THE INVENTION

Perhaps desirable characteristics of a bassinet are 1) sufficient height such that the baby sleeps at night at generally the same level as his or her parents, 2) sturdiness such that the bassinet cannot tip from an unintended bump from an older child or a jump up from a larger dog, 3) relative weight such that the bassinet may be carried easily from room to room or from house to car, and 4) foldability from an operating state to a compact state such that the bassinet may take up minimal space in a car or in a closet. In sum, it is a rather difficult search to find a relatively light and sturdy bassinet of a sufficient size that is readily transportable.

SUMMARY OF THE INVENTION

A feature of the present invention is the provision in a bassinet apparatus, of a set of upper hubs, a set of lower hubs, and a scissoring leg arrangement between the upper and lower hubs, where the scissoring leg arrangement includes an open and expanded form, where the scissoring leg arrangement includes a closed and collapsed form, where the scissoring leg arrangement is foldable in from the open and expanded form to the closed and collapsed form, and where the scissoring leg arrangement is foldable out from the closed and collapsed form to the open and expanded form.

Another feature of the present invention is the provision in a bassinet apparatus, of a set of corner posts, where each of the corner posts engage one upper hub and one lower hub.

Another feature of the present invention is the provision in a bassinet apparatus, of a set of intermediate posts, where each of the intermediate posts is between two of the corner posts, and where each of the intermediate posts engage one upper hub and one lower hub.

Another feature of the present invention is the provision in a bassinet apparatus, of a flexible receptacle engaged with each of the corner posts and each of the intermediate posts.

Another feature of the present invention is the provision in a bassinet apparatus, of the flexible receptacle riding on the upper hubs.

Another feature of the present invention is the provision in a bassinet apparatus, of the flexible receptacle having a flexible floor and an endless flexible sidewall.

Another feature of the present invention is the provision in a bassinet apparatus, of the floor slidingly engaging each of the corner and intermediate posts.

Another feature of the present invention is the provision in a bassinet apparatus, of the endless flexible sidewall slidingly engaging each of the corner and intermediate posts.

Another feature of the present invention is the provision in a bassinet apparatus, of the flexible receptacle being compressible into a compact form when the scissoring leg arrangement is folded in from the open and expanded form to the closed and collapsed form.

Another feature of the present invention is the provision in a bassinet apparatus, of the flexible receptacle being expandable into an operating form when the scissoring leg arrangement is folded out from the closed and collapsed form to the open and expanded form.

Another feature of the present invention is the provision in a bassinet apparatus, of the endless flexible sidewall including an upper endless section and a lower endless section, where the upper endless section includes an outer layer disposed outwardly of the corner and intermediate posts and an inner layer disposed inwardly of the corner and intermediate posts, and where the lower endless section includes an endless mesh portion disposed inwardly of the corner and intermediate posts.

Another feature of the present invention is the provision in a bassinet apparatus, of the endless sidewall including an upper endless section that generally forms an upside down U-shape that receives each of the corner and intermediate posts.

Another feature of the present invention is the provision in a bassinet apparatus, of the upper endless section including an outer layer facing outwardly relative to the flexible receptacle and an inner layer facing inwardly relative to the flexible receptacle, where the outer and inner layers face in opposite directions relative to each other, and where the corner and intermediate posts are disposed between the outer and inner layers.

Another feature of the present invention is the provision in a bassinet apparatus, of the outer and inner layers running parallel to each other, where the outer and inner layers include lower edges that run adjacent to each other, and where the outer and inner layers include upper portions that form an endless upper junction.

Another feature of the present invention is the provision in a bassinet apparatus, of the flexible receptacle being free of horizontally extending support members that are rigid, and where the endless flexible sidewall consists essentially of sheeting.

Another feature of the present invention is the provision in a bassinet apparatus, of the flexible receptacle engaging no horizontally extending support members that are rigid and of the flexible receptacle including no horizontally extending support members that are rigid.

Another feature of the present invention is the provision in a bassinet apparatus, of, when the flexible receptacle is in the open and expanded form, each of the corner and intermediate posts including an upper post section extending upwardly beyond the floor of the flexible receptacle, where each of the upper post sections engages adjacent upper post sections with flexible material only extending between said adjacent upper post sections.

Another feature of the present invention is the provision in a bassinet apparatus, of the endless sidewall including an endless outer layer with an endless bottom edge section having portions that engage each of the corner and intermediate posts, where the endless sidewall includes an endless inner layer with an endless bottom edge section having portions that engage each of the corner and intermediate posts.

Another feature of the present invention is the provision in a bassinet apparatus, of each of the corner and intermediate posts including an upper section having an uppermost elongate portion, where each of the corner and intermediate posts have a diameter, where the uppermost elongate portion includes a length greater than such diameter, and where the endless sidewall includes an upside down pocket engaging the uppermost elongate portion.

Another feature of the present invention is the provision in a bassinet apparatus, of the upper section including first and second tapering side edges tapering downwardly from the uppermost elongate portion, where the first and second tapering side edges taper toward each other.

Another feature of the present invention is the provision in a bassinet apparatus, of the flexible receptacle including an open top.

Another feature of the present invention is the provision in a bassinet apparatus, of a) the flexible floor including a perimeter, of b) the flexible receptacle including an endless mesh section that extends upwardly from the flexible floor, where the bottom of the endless mesh portion is spaced from the perimeter of the flexible floor, of c) an endless upside down U-shaped section, where the endless upside down U-shaped section includes an endless outer wall portion and an endless inner wall portion, where the endless upside down U-shaped section engages each of the corner and intermediate posts, where the endless outer wall portion is disposed outwardly of the posts, and where the endless inner wall portion is disposed inwardly of the posts, and of d) the endless inner wall portion and endless mesh section engaging each other along an endless junction.

Another feature of the present invention is the provision in a bassinet apparatus, of a pad assembly removably engaged to the flexible floor, where a periphery of the pad assembly is adjacent to the endless sidewall of the flexible receptacle, where the pad assembly includes first, second, and third sections, where the first section is hingedly engaged to the second section, where the second section is hingedly engaged to the third section, where the second section is stackable on the first section such that peripheral edges of the first and second sections are adjacent to each other, where the third section is stackable on the second section such that peripheral edges of the second and third sections are adjacent to each other, where each of the first, second, and third sections is engagable to at least one rigid elongate member such that, when the first, second, and third sections are engaged by the at least one rigid elongate member, the first, second, and third sections are disposed in generally a common plane.

Another feature of the present invention is the provision in a bassinet apparatus, of the flexible floor folding in when the scissoring leg arrangement folds in and of the flexible floor folding out when the scissoring leg arrangement folds out.

Another feature of the present invention is the provision in a bassinet apparatus, of, when the scissoring leg arrangement is folded in from the open and expanded form to the closed and collapsed form, the upper hubs slidingly push the flexible floor toward upper portions of the corner and intermediate posts.

Another feature of the present invention is the provision in a bassinet apparatus, of the endless sidewall including an upper upside down U-shaped portion having outer and inner walls, where the outer wall includes an inner face and a bottom edge, where the bottom edge of the inner face of the outer wall includes portions that slidingly engage each of the corner and intermediate posts, where the inner wall includes an inner face and a bottom edge, where the bottom edge of the inner face of the inner wall includes portions that slidingly engage each of the corner and intermediate posts, and where, when the scissoring leg arrangement is folded in from the open and expanded form to the closed and collapsed form, the upper hubs slidingly push the bottom edges of the outer and inner walls upwardly on the corner and intermediate posts.

Another feature of the present invention is the provision in a bassinet apparatus, of the endless sidewall including an endless upside down pocket having an upper portion that is closed and a lower portion that is open, wherein each of the corner and intermediate posts extends into the endless upside down pocket, and where each of the corner and intermediate posts includes an upper end that is adjacent to the upper portion of the upside down pocket.

Another feature of the present invention is the provision in a bassinet apparatus, of a) a set of upper hubs, of b) a set of lower hubs, of c) a scissoring leg arrangement between the upper and lower hubs, where the scissoring leg arrangement includes an open and expanded form, where the scissoring leg arrangement includes a closed and collapsed form, where the scissoring leg arrangement is foldable in from the open and expanded form to the closed and collapsed form, and where the scissoring leg arrangement is foldable out from the closed and collapsed form to the open and expanded form, of d) a set of corner posts, where each of the corner posts engage one upper hub and one lower hub, of e) a flexible receptacle engaged with each of the corner posts, where the flexible receptacle rides on the upper hubs, of f) the flexible receptacle having a flexible floor and an endless flexible sidewall, and of g) the flexible floor slidingly engaging each of the corner posts and the endless sidewall slidingly engaging each of the corner posts such that the flexible receptacle is compressible into a compact form when the scissoring leg arrangement is folded in from the open and expanded form to the closed and collapsed form and such that the flexible receptacle is expandable into an operating form when the scissoring leg arrangement is folded out from the closed and collapsed form to the open and expanded form.

Another feature of the present invention is the provision in a bassinet apparatus, of a) a set of corner posts, of b) a set of intermediate posts, where each of the intermediate posts is between two of the corner posts, of c) a flexible receptacle engaged with each of the corner posts and each of the intermediate posts, of d) the flexible receptacle having a floor and an endless sidewall, of e) the floor engaging each of the corner posts and each of the intermediate posts, of f) the endless sidewall engaging each of the corner posts and each of the intermediate posts, of g) the floor including a perimeter, of h) the flexible receptacle including an endless mesh section that extends upwardly from the floor, where the bottom of the endless mesh portion is spaced from the perimeter of the floor, of i) an endless upside down U-shaped section, where the endless upside down U-shaped section includes an endless outer wall portion and an endless inner wall portion, where the endless upside down U-shaped section engages each of the corner and intermediate posts, where the endless outer wall portion is disposed outwardly of the posts, and where the endless inner wall portion is disposed inwardly of the posts, and of j) the endless inner wall portion and endless mesh section engaging each other along an endless junction.

An advantage of the present invention is that it is safe. One feature contributing to this advantage is the inclusion of six platforms for the scissoring leg arrangement instead of the conventional four legs. Another feature contributing to this advantage is that each of the six platforms is relatively broad longitudinally and relatively broad laterally. Another feature contributing to this advantage is the receptacle being spaced inwardly from the corner posts, from the intermediate posts, and from the perimeter of the floor so as to maximize the chances that a baby is placed closed to the center portion of the floor. Another feature contributing to this advantage is that the scissoring leg arrangement distributes weight amongst the six platforms.

Another advantage of the present invention is that it is relatively light. One feature contributing to this advantage is that the scissoring leg arrangement, including the corner and intermediate posts, includes frame members that are tubular. The corner and intermediate posts are tubular. The side oblique legs, end oblique legs, and interior oblique legs are tubular. Another feature contributing to this advantage is that the receptacle includes no rigid framework and no horizontally extending rigid frame members. Another feature contributing to this advantage is that the receptacle, where the small child lies, is flexible and formed of fabric or sheeting.

Another advantage of the present invention is that it includes a relatively large operating form and a relatively small form in which it can be shipped, transported, and stored. One feature contributing to this advantage is the scissoring leg arrangement. Another feature contributing to this advantage is the flexible receptacle that can be folded to a relatively small form. Another feature contributing to this advantage is that the scissoring leg arrangement and flexible receptacle are folded in and folded out at the same time by the same motion.

Another advantage of the present invention is that it is relatively inexpensive to manufacture.

Another advantage of the present invention is that each of the scissoring leg arrangement and flexible bassinet is easy and simple to open and close.

Another advantage of the present invention is that the employment of a see-through material, namely a mesh material, is maximized to provide visibility for the small child and caretakers to see each other.

DESCRIPTION

Figure 1:
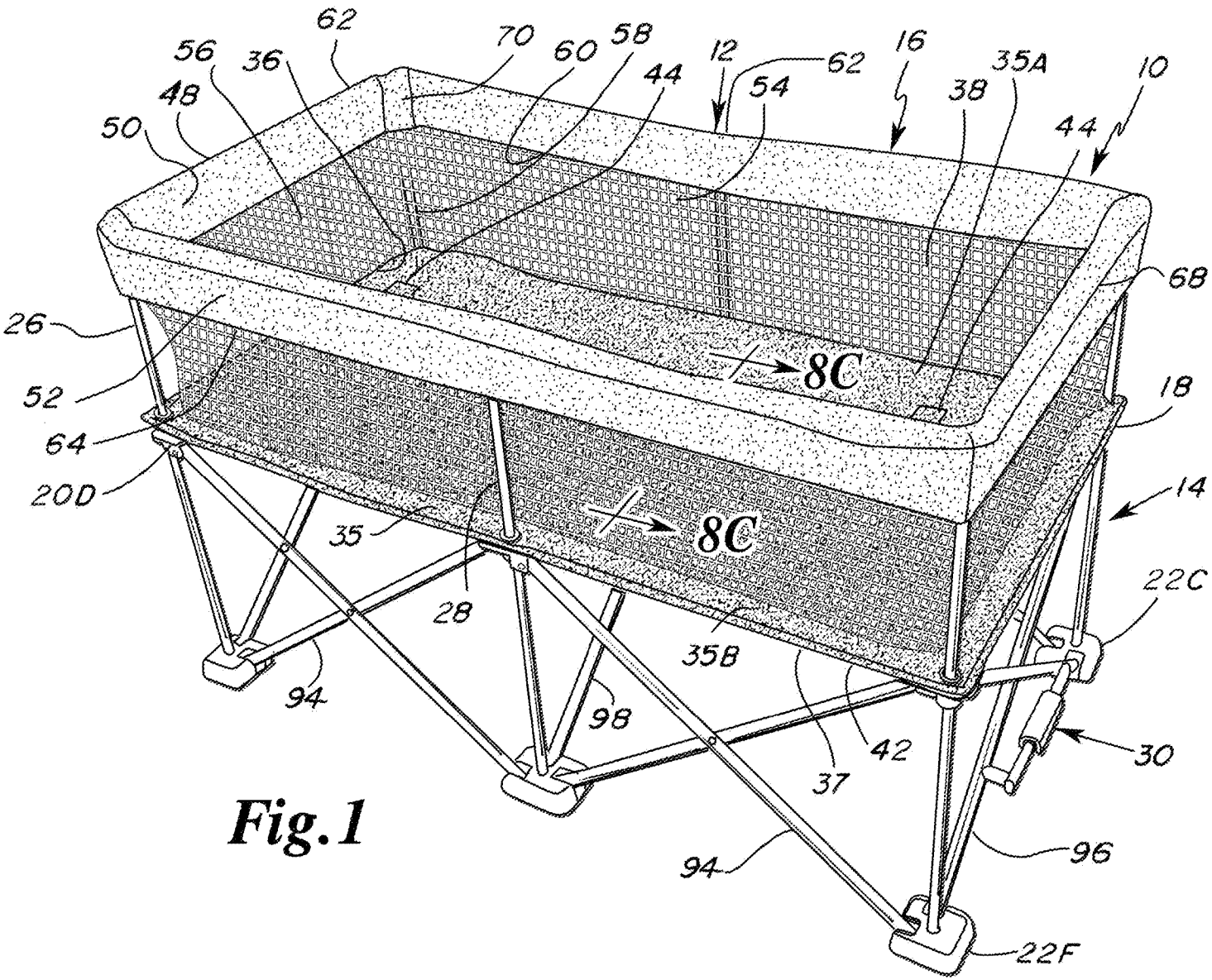
FIG. 1 is a perspective view of the present bassinet apparatus.

As shown in FIG. 1, the present collapsible bassinet apparatus is indicated in general by the reference number 10. The bassinet apparatus 10 includes a flexible receptacle 12 and a scissoring leg arrangement 14. The flexible receptacle 12 includes an endless flexible sidewall 16 and a flexible floor 18. The scissoring leg arrangement 14 includes a set of upper hubs 20A-F, a set of lower hubs 22A-F, oblique support members 94, 96, 98, a set of corner posts 26, a set of intermediate posts 28, and a set of over center locks 30.

Floor 18 is rectangular with four corner portions. Each of the corner portions includes a corner grommet or corner eyelet 32 that forms a through opening for receiving a corner post 26. Intermediate of the corner portions and grommets 32, on each of the sides of the bassinet apparatus 10, is an intermediate grommet or intermediate eyelet 34 that forms a through opening for receiving one of the intermediate posts 28. Floor 18 and its grommets 32, 34 slidingly receive the corner and intermediate posts 26, 28 such that when the scissoring leg arrangement 14 is closed, the upper hubs 20A-F push the floor 18 into a folded and compact form, which in turn at the same time pushes the flexible receptacle 12 as a whole into a folded compact form. Grommets 32, 34 are preferably formed of metal with a slippery inner annular surface, and corner and intermediate posts 26, 28 are preferably formed of metal with a slippery outer diametrical surface such that friction between the grommets 32, 34 and corner and intermediate posts 26, 28 is minimized. When the bassinet apparatus 10 is turned upside down so as to be supported on a surface by the normally upper ends of the corner and intermediate posts 26, 28, as shown in FIG. 4, the receptacle 12 slides under the influence of gravity away from the upper hubs 20A-F, in which position the floor 18 is spaced from the upper hubs 20A-F and in which position the flexible receptacle 12 compacts upon itself, or folds upon itself, or self compacts so as to take a generally flattened scrunched up form.

Floor 18 is sheeting. Floor 18 may be a sheet of textile fabric. Floor 18 includes a double layer 35 of sheeting around the periphery 37 of the floor 18 and employs this double layer 35, or a folded back portion 35, to engage a perimeter lower portion 36 of a mesh section 38 of the flexible endless sidewall 16 of the receptacle 12.

Figure 4:
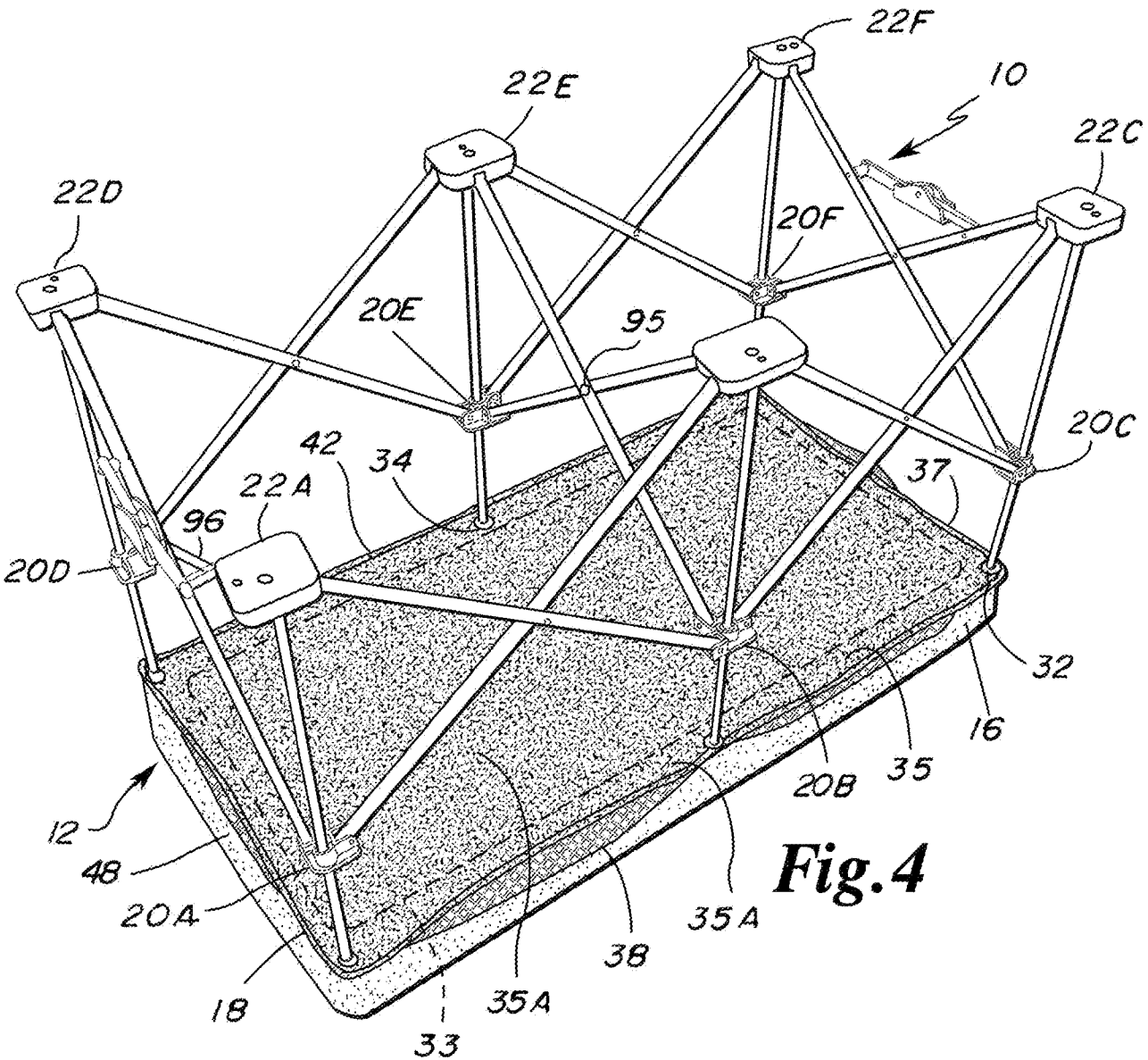
FIG. 4 is a bottom perspective view of the bassinet apparatus of FIG. 1 where the flexible receptacle has slid away from the upper hubs under the influence of gravity so as to be spaced from the upper hubs, and where the sidewalls of the flexible receptacle have been scrunched down under the weight of the flexible receptacle.

First layer 35A of the double layer 35 is shown in FIG. 4. Second layer 35B is shown in FIG. 1. First layer 35A is also shown in FIG. 1. Second layer 35B is folded up on top of first layer 35A. First layer 35A is a bottom layer. Second layer 35B is an upper layer. Layers 35A and 35B are one piece and integral with each other. Stitching 33, shown in FIG. 4, engages an inner rectangular edge of layer 35B to layer 35A. First layer 35A runs the full length of the floor 18 from end to end and further runs the full width of the floor 18 from side to side. Reference number 35 designates a double layer. Reference number 35B designates a single layer or single sheet. Reference number 35A designates a single layer or single sheet.

The periphery 37 of the floor 18 is defined by or includes a U-shaped strip 42 having an upper portion on the upper surface of the floor perimeter double layer and a lower portion on the lower surface of the floor double layer. This U-shaped strip 42 acts like a bumper to minimize tears in the double layer 35. Grommets 32, 34 are spaced inwardly of and from the bumper strip 42. Bumper strip 42 is shown, for example, in FIGS. 8A and 8B.

Grommets 32, 34 are set in the double layer or double layer perimeter or double layer band 35. At the corner portions, the floor 18 may have two double layers 35 or double layer bands 35 that overlap such that corner grommets 32 are set in such four layers. Intermediate grommets 34 are set in the double layer 35 such that intermediate grommets 34 are set in two layers of sheeting. Laterally and longitudinally between the double layer 35 that runs about the periphery 37 of the floor 18, floor 18 is a single layer of sheeting. For example, floor 18 includes two ends, with each of the ends including a portion of the perimeter double layer 35. Floor 18 includes a single layer between the inner edge of the double layer 35 on one end and the inner edge of the double layer 35 on the other end. Likewise, floor 18 includes two longitudinally extending sides, and floor 18 includes a single layer between the inner edge of the double layer 35 extending down one side and the opposite inner edge of the double layer 35 extending down the other side of the floor 18.

Floor 18 further includes a pair of Velcro® strips 44 engaged on its upper interior surface. Strips 44 are quick connect strips 44 formed of one of a macroscopic hook or loop material. Each of the strips 44 is elongate and extend laterally. One strip 44 is on one end portion of the floor 18. The other strip 44 is on the other end portion of the floor 18. Strips 44 engage a pad assembly 46 shown in FIG. 7A.

Flexible receptacle 12 includes mesh section 38 and further includes an endless upside down pocket 48 having an inner wall 50 and an outer wall 53. Mesh section 38 is engaged between floor 18 and inner wall 50 of the endless pocket 48. The folded back double layer band 35 includes an inner edge. The mesh lower portion 36 of the mesh section 38 is tucked under this folded back double layer band 35 and engaged, such as by stitching 33, to the double layer band 35. The mesh lower portion 36 rises from the floor 18 at the inner edge of the folded back double layer band 35. The mesh lower portion 36 of the mesh section 38 is disposed inwardly from and spaced from each of the corner ports 26 and each of the intermediate posts 28. Mesh section 38 is flexible, is sheeting, and is see-through. A child on the floor 18 in the receptacle 12 can see persons and things on the other side of the mesh section 38. Caretakers can see the interior of the receptacle 12 from outside of the mesh section 38. Mesh section 38 is endless and includes opposite sides and opposite ends. Mesh section 38 runs longitudinally on the sides of the bassinet apparatus 10 and runs laterally on the ends of the bassinet apparatus 10. Mesh section 38 includes four mesh panels consisting of two side mesh panels 54 and two end mesh panels 56. A side mesh panel 54 intersects with an end mesh panel 56 at a corner junction 58. There are four corner junctions 58. Each of the corner mesh junctions 58 runs vertically from the floor 18 to the inner wall 50 of the endless pocket 48. Each of the four corner mesh junctions 58 includes a folded over panel edge that is engaged, such as by stitching, to a folded over panel edge of the adjacent mesh panel to provide resistance against tearing at the corner mesh junctions 58.

Mesh section 38 is engaged, such as by stitching, to a lower portion of inner wall 50 of endless pocket 48 at endless junction 60. Inner wall 50 rises from the endless junction 60 with mesh section 38 to an upper endless integral junction 62 with the outer wall 52 of the endless pocket 58. Outer wall 52 extends downwardly from the upper endless junction 62 to terminate at a lower endless free edge 64. Junction 62 is an integral junction or bend from inner wall 50 to outer wall 52. There is no stitching at this junction 62. Junction 62 defines the top of endless pocket 48.

Figure 6:
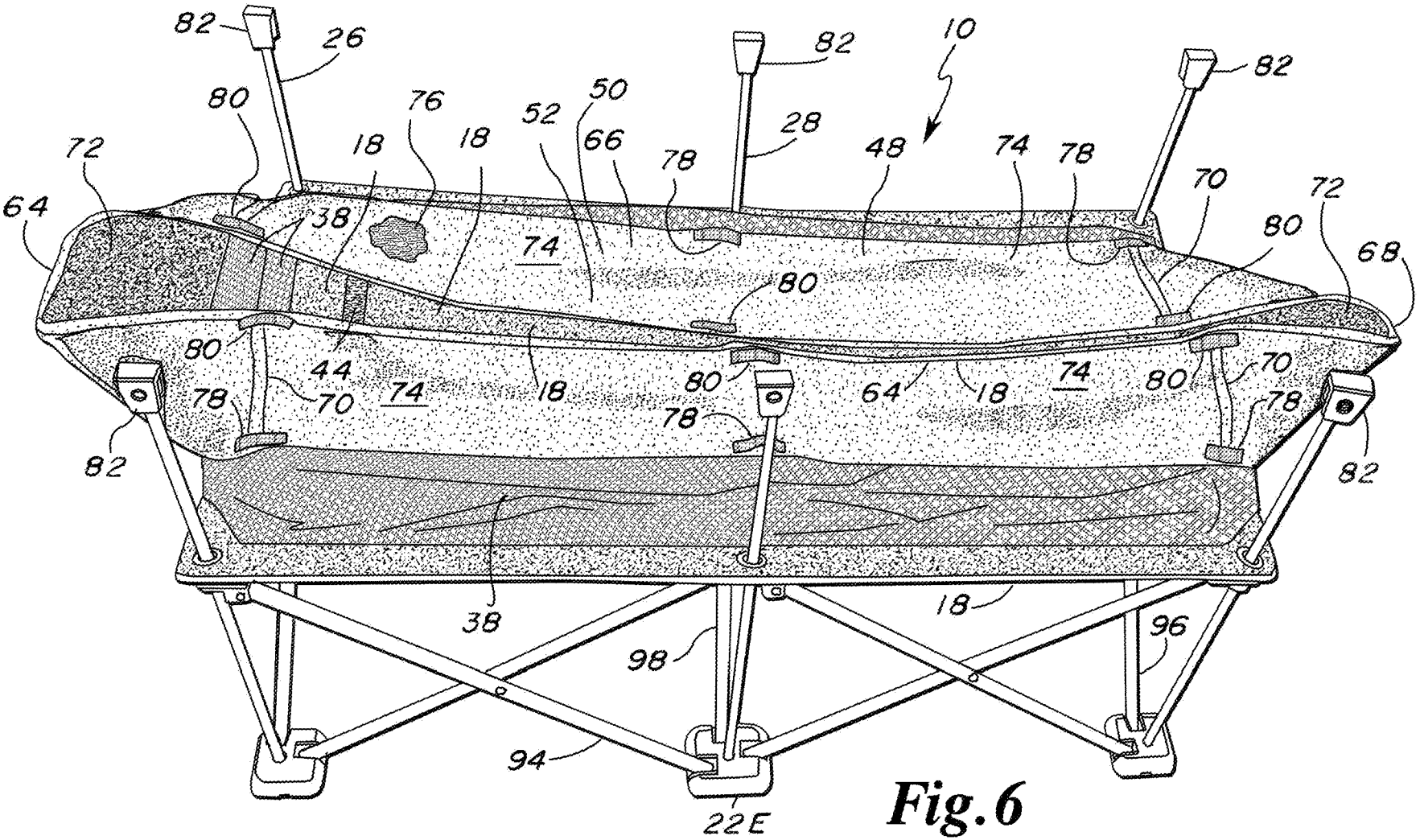
FIG. 6 is a perspective view of the bassinet apparatus of FIG. 1 where the endless sidewall of the flexible receptacle has been disengaged from the frame of the bassinet apparatus.
Figure 8C:
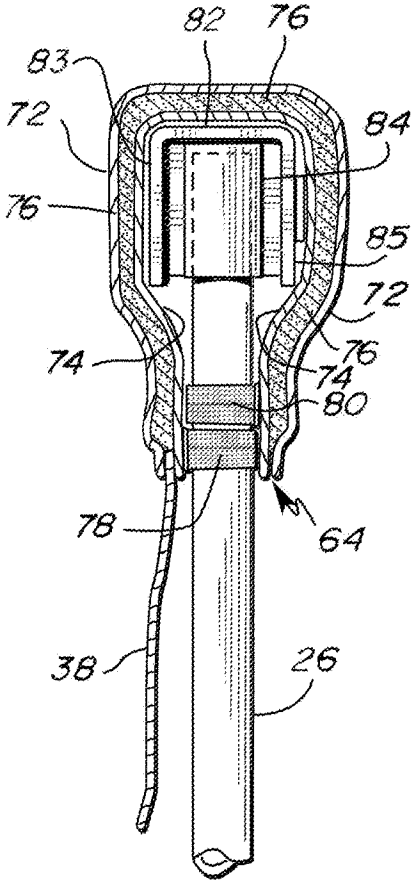
FIG. 8C is a section view at lines 8C-8C of FIG. 1 of the intermediate post captured by the upside down endless pocket of the sidewall of the flexible receptacle of the bassinet apparatus of FIG. 1, and where the intermediate post is engaged by elastic strips extending from inside lower edge portions of the upside down endless pocket.

As shown in FIG. 6 and FIG. 8C, inner and outer walls 50, 52 are part of the same piece of sheeting or textile fabric, i.e., layers 72, 76, 74 shown in FIG. 8C. Pocket 48 includes two side sections 66 and two end sections 68. Each of the side sections 66 is engaged, such as by stitching, to each of the two end sections 68 at a corner junction 70.

Endless pocket 48 includes an exterior layer 72 that is visible to the viewer in the normal operation state of the bassinet apparatus 10, whether the viewer is the small child in the receptacle 12 or whether the viewer is the caretaker from outside of the bassinet apparatus 10, where the normal state of operation is shown in FIG. 1. Endless pocket 48 includes an interior layer 74 that is not visible to the viewer in the normal operation state of the bassinet apparatus 10, where the normal state of operation is shown in FIG. 1. Interior layer 74 is visible in FIG. 6 where the endless pocket 48 has been disengaged from each of the corner and intermediate posts 26, 28. Sandwiched between the exterior and inner layers 72, 74 is an endless cushion layer 76. Cushion layer 76 is a resilient material such as a closed cell foam or an open cell foam. Inner wall 50 includes a portion of the interior layer 74, a portion of the exterior layer 72, and a portion of the cushion layer 76. Outer wall 52 includes a portion of the interior layer 74, a portion of the exterior layer 72, and a portion of the cushion layer 76.

Endless pocket 48 further includes inner and outer strips 78, 80 of elastic material. There are six inner strips 78 and six outer strips 80. Each of the inner strips 78 is engaged on a lower portion of the inner wall 50 at a corner of the endless pocket 48 or at an intermediate portion of the endless pocket 48. Each of the outer strips 80 is engaged on a lower portion of the outer wall 52 at a corner of the endless pocket 48 or at an intermediate portion of the endless pocket 48. Each of the inner strips 78 extends from the interior layer 74 so as to be hidden from view when the bassinet apparatus 10 is in the normal operation state of FIG. 1. Each of the outer strips 80 extends from the interior layer 74 so as to be hidden from view when the bassinet apparatus 10 is in the normal state of operation of FIG. 1. Each of the inner and outer strips 78, 80 are visible in FIG. 6 where the endless pocket 48 has been disengaged from the corner and intermediate posts 26, 28. Each of the inner strips 78 is paired with and opposes one of the outer strips 80 such that there are six pairs of opposing strips 78, 80.

Each pair of opposing strips 78, 80 engages one of the corner or intermediate posts 26, 28 by being resiliently stretched over a stop 82. There are six stops 82. One stop 82 is engaged to a top of each of the corner and intermediate posts 26, 28. Stop 82 includes a plate like inner quadrilateral side 83 and a plate like outer quadrilateral side 85. Engaged between the plate like sides 83, 85 is a cylindrical receptor 84 for a corner post 26 or an intermediate post 28. Stop 82 further includes a top 88 and a bottom 90. Stop 82 further includes tapering side edges 86 that taper toward each other and downwardly from the top 88 of the stop 82 to the bottom 90 of the stop 82. Strips 82 are stretched over the top 88 of stop 82 to engage the endless pocket 48 to the corner and intermediate posts 26, 28. Bottoms 90 of the stops 82 prevent the elastic strips 78, 80 from slipping upwardly over the stops 82 unless the elastic strips 78, 80 are manually stretched. Bottom 90 has a longitudinal length that is greater than the diameter of corner post 26 or intermediate post 28. Top 88 has a longitudinal length that is greater than the longitudinal length of bottom 90. The top 88 of the stop 82 is elongate and relatively wide from side face to side face such that pocket upper integral junction 62 resides without tearing on the top of the stop 82. Stop 82, or the top 88 of stop 82, holds up the endless sidewall 16 of the receptacle 12. Stop 82, or the top 88 of stop 82, holds up the receptacle 12, with some, albeit minimal, aid from the upper hubs 20A-F upon which the floor 18 rests. Stop 82, or the top 88 of the stop 82, pushes up the endless sidewall 16 and receptacle 12 when the scissoring leg arrangement 14 scissors from the open configuration shown in FIG. 1 to the closed configuration shown in FIG. 5. Stops 82 in unison hold the endless pocket 48 upright and in a somewhat tensioned state when the bassinet apparatus 10 is in the normal operating state shown in FIG. 1 when the scissoring leg arrangement 14 is open and the over center locks 30 are locked. The somewhat tensioned state of the endless pocket 48 provides some rigidity to the sidewall 16 of the receptacle 12 even though the sidewall 16 includes no rigid horizontally extending support members between any two adjacent posts 26, 28. When the scissoring leg arrangement 14 expands from the closed and compact state of FIG. 5 to the open and operating state of FIG. 1, the endless sidewall 16 expands laterally, longitudinally, and height-wise as a result of adjacent corner posts 26 spreading apart laterally from each other, as a result of intermediate posts 28 spreading apart laterally from each other, as a result of adjacent corner and intermediate posts 26, 28 spreading apart longitudinally, as a result of corner posts 26, that are on the same side of the receptacle 12, spreading apart from each other longitudinally, as a result of both sets of the obliquely related corner posts 26 spreading apart both laterally and longitudinally from each other, and as a result of the weight of the floor 18 pulling down endless sidewall 16. Such an expansion provides some tension to the endless sidewall 16, endless pocket 48, and endless mesh section 38 such that no horizontal frame members, or other rigid frame members, between adjacent posts 26, 28 are required.

Each of the corner posts 26 extends through one of the corner upper hubs 20A, 20C, 20D, 20F and is anchored in one of the corner lower hubs 22A, 22C, 22D, 22F. Each of the intermediate posts 28 extends through one of the intermediate upper hubs 20B, 20E and is anchored in one of the intermediate lower hubs 22B, 22E. Upper hubs 20A-F slidingly engage the corner and intermediate posts 26, 28. Corner posts 26, intermediate posts 28, upper hubs 20A-F, and lower hubs 22A-F are part of the scissoring leg arrangement 14.

The scissoring leg arrangement 14 further includes side oblique support members 94. There are eight side oblique support members 94, four on one side of the bassinet apparatus 10 and four on the opposing side of the bassinet apparatus 10. The side oblique support members 94 are tubular and formed of metal. Each of the side oblique support members 94 extends between a hub engaged to a corner post 26 and a hub engaged to an intermediate post 28. Each of the side oblique support members 94 extends between an upper hub 20A-F and a lower hub 22A-F. Each of the side oblique support members 94 is pivotally engaged at each of its ends to one of the upper hubs 20A-F and lower hubs 22A-F. Each of the side oblique support members 94 is pivotally engaged at an intermediate location to an intermediate location of another side oblique support member 94 by a pivot pin 95.

The scissoring leg arrangement 14 further includes end oblique support members 96. The end oblique support members 96 are tubular and formed of metal. There are four end oblique support members 96, two on one end of the bassinet apparatus 10 and two on the opposing end of the bassinet apparatus 10. Each of the end oblique support members 96 extends between a hub engaged to a corner post 26 and a hub engaged to an adjacent corner post 26. Each of the end oblique support members 96 extends between an upper corner hub 20A, 20C, 20D, 20F and a lower corner hub 22A, 22C, 22D, 22F. Each of the end oblique support members 96 is pivotally engaged at each of its ends to one of the corner hubs 20A, 20C, 20D, 20F and corner hubs 22A, 22C, 22D, 22F. Each of the end oblique support members 96 is pivotally engaged at an intermediate location to an intermediate location of another end oblique support member 96 by a pivot pin 95.

The scissoring leg arrangement 14 further includes interior oblique support members 98. There are two interior oblique support members 98. The interior oblique support members 98 are tubular and formed of metal. Each of the interior oblique support members 98 extends between a hub engaged to an intermediate post 28 and a hub engaged to the other intermediate post 28. Each of the interior oblique support members 98 extends between an upper hub 20B, 20E and a lower hub 22B, 22E. Each of the interior oblique support members 98 is pivotally engaged at each of its ends to one of the hubs 20B, 20E, and hubs 22B, 22E. Each of the interior oblique support members 98 is pivotally engaged at an intermediate location to an intermediate location of the other interior oblique support member 98 by a pivot pin 95.

The corner and intermediate posts 26, 28 are tubular and formed of metal.

Figure 9A:
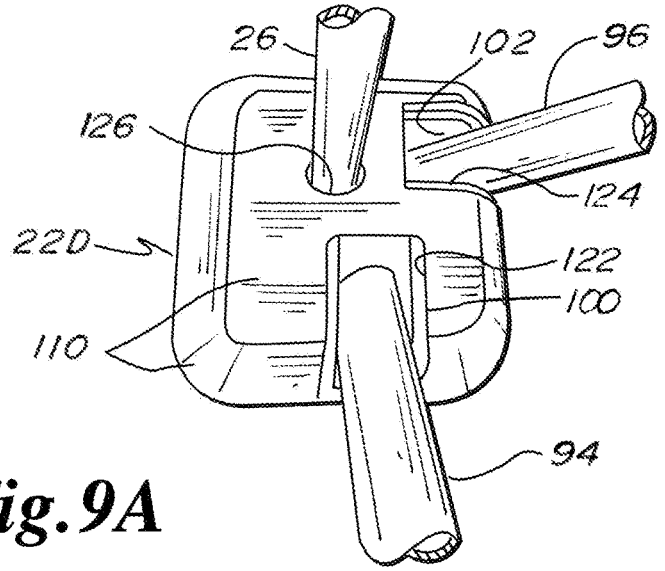
FIG. 9A is a top perspective detail view of a corner lower hub of the bassinet apparatus of FIG. 1.
Figure 9B:
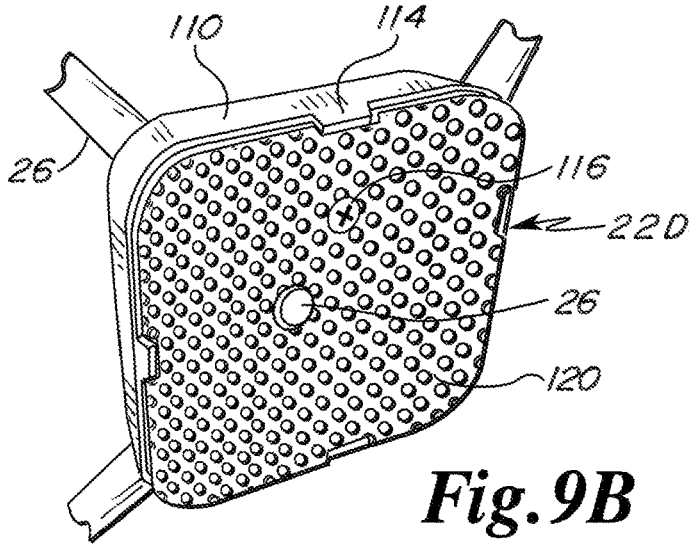
FIG. 9B is a bottom perspective detail view of the corner lower hub of FIG. 9A.

FIGS. 9A, 9B, 9C, and 14B show hub 22D. There are four lower corner hubs 22A, 22C, 22D, 22F on the bassinet apparatus 10. Each of these hubs has the same features though such features are not arranged identically. Lower corner hub 22D pivotally engages one side oblique support member 94 and one end oblique support member 96. Lower corner hub 22D fixedly engages vertical corner post 26. A three sided or U-shaped receptor 100 receives side oblique support member 94, which is pivotally engaged to two opposing sides of the receptor 100 with a pivot pin 101. A three sided or U-shaped receptor 102 receives end oblique support member 94, which is pivotally engaged to two opposing sides of the receptor 102 with a pivot pin 101. The receptors 100, 102 share a common floor or base 104. Corner post 26 is received in a cylindrical receptor 106 integral with the floor 104. Corner post 26 is fixed in cylindrical receptor 106 with a pin passing through the receptor 106 and engaging the corner post 26. Receptors 100, 102, 106 are integral with floor 104 and integral with each other. Floor 104 is further integral with a pair of locator receptors 108 that receive plastic pin locators depending from the inside of cover 110. Floor 104 further includes a set of four indents 112, one on each side of the floor 104, to receive locators 114 formed on the sides of the cover 110. A pin connector 116 pierces the floor 104 and engages a cylindrical receptor depending from the cover 110. Removal of pin connector 116 permits disengagement of cover 110 from floor 104. Corner post receiving cylindrical receptor 106 is connected to receptors 100, 102 through the floor 104 and further through bridging walls 118. Floor 104 includes a roughened bottom face 120 having an array of nubs projecting therefrom to provide a non-slip surface or a surface that minimizes slipping. As shown in FIG. 9B, corner post receiving cylindrical receptor 106 defines a thru opening that opens through the floor 104. Cover 110 includes a first opening 122 for receptor 100, a second opening 124 for receptor 102, and a third opening 126 for corner post 26. First opening 122 is tailored to expose the top edges of the two parallel sides of receptor 100 and cover the top edge of the third and inner wall of receptor 100. Second opening 124 is tailored to expose the top edges of the two parallel sides of receptor 102 and cover the top edge of the third and inner wall of receptor 102. Third opening 126 is tailored to cover the top edge of the corner post receiving receptor 106. A top face of cover 110 tapers in a curvilinear fashion to the sides of the cover 110.

Figure 10A:
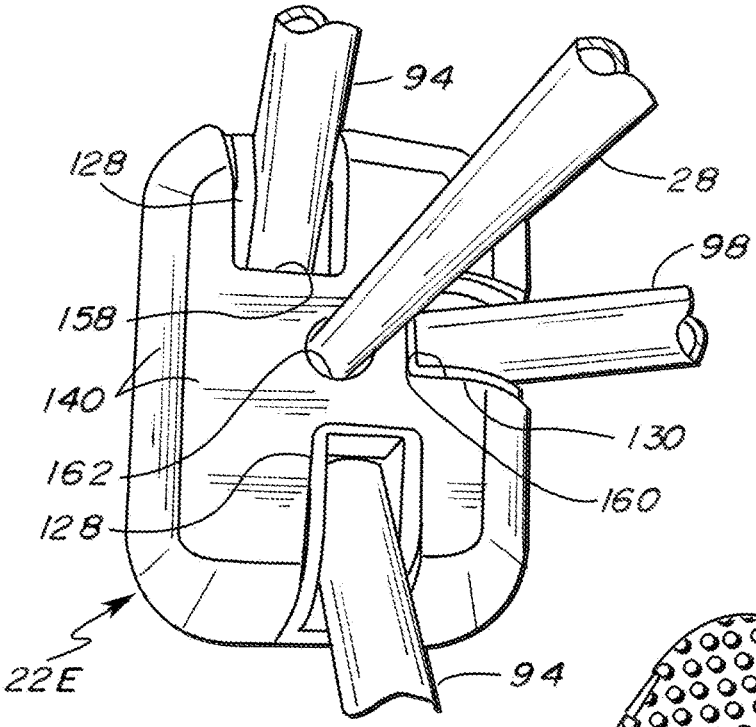
FIG. 10A is a top perspective detail view of an intermediate lower hub of the bassinet apparatus of FIG. 1.
Figure 10B:
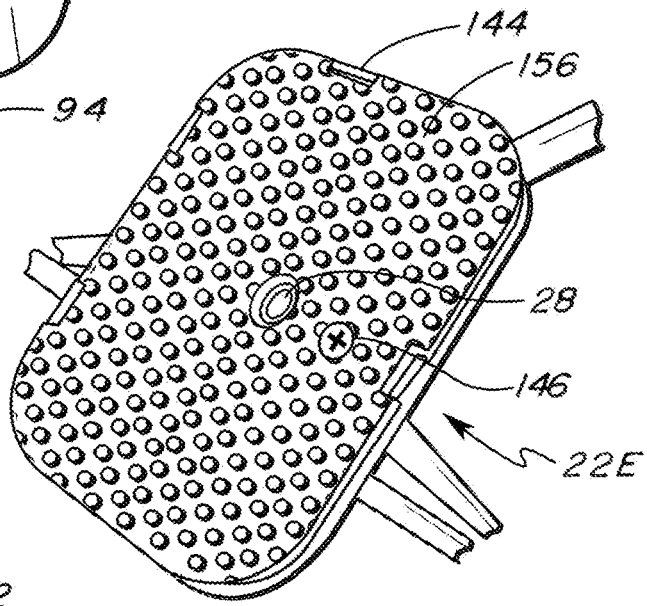
FIG. 10B is a bottom perspective detail view of the intermediate lower hub of FIG. 10A.
Figure 10C:
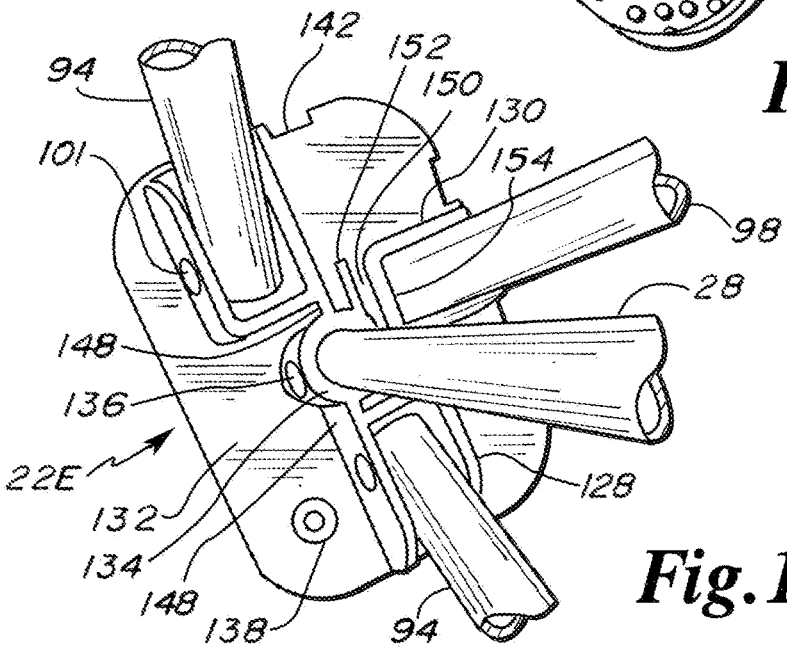
FIG. 10C is a top perspective detail view of the intermediate lower hub of FIG. 10A with the cover of such hub removed.

FIGS. 10A, 10B, and 10C show lower intermediate hub 22E. There are two lower intermediate hubs 22E, 22B on the bassinet apparatus 10. Each of these hubs has the same features though such features are not arranged identically. Lower intermediate hub 22E pivotally engages two side oblique support members 94 and one interior oblique support member 98. Lower intermediate hub 22E fixedly engages vertical intermediate post 28. Three sided or U-shaped receptors 128 receive side oblique support members 94, each of which is pivotally engaged to two opposing sides of the receptor 128 with a pivot pin 101. A three sided or U-shaped receptor 130 receives interior oblique support member 98, which is pivotally engaged to two opposing sides of the receptor 130 with a pivot pin. The receptors 128, 130 share a common floor or base 132. Intermediate post 28 is received in a cylindrical receptor 134 integral with the floor 132. Intermediate post 28 is fixed in cylindrical receptor 134 with a pin passing through the receptor 134 and engaging the intermediate post 28. Receptors 128, 130, and 134 are integral with floor 132 and integral with each other. Floor 132 is further integral with a locator receptor 138 that receives a plastic pin locator depending from the inside of cover 140. Floor 132 further includes a set of four indents 142, two on one side of the floor 132, one on a second side of the floor 132, one on a third side of the floor 132, with one side of the floor 132 being free of such indents 142. Indents 142 receive locators 144 formed on the sides of the cover 140. A pin connector 146 pierces the floor 132 and engages a cylindrical receptor depending from the cover 140. Removal of pin connector 146 permits disengagement of cover 140 from floor 132. Intermediate post receiving cylindrical receptor 134 is connected to receptors 128, 130 through the floor 132 and further through bridging walls 118. A slot 150 between walls 152, 154 receives a plate like extension depending from cover 140. Floor 132 includes a roughened bottom face 156 having an array of nubs projecting therefrom to provide a non-slip surface or a surface that minimizes slipping. As shown in FIG. 10B, intermediate post receiving cylindrical receptor 134 defines a thru opening that opens through the floor 132. Cover 140 includes first and second openings 158 for receptors 128, a third opening 160 for receptor 130, and a fourth opening 162 for intermediate post 28. First and second openings 158 are tailored to expose the top edges of the two parallel sides of the first and second receptors 128 and to cover the third and inner wall of receptors 128. Third opening 160 is tailored to expose the top edges of the two parallel sides of the third receptor 130 and to cover the third and inner wall of receptor 130. Fourth opening 162 is tailored to cover the top edge of the cylindrical wall of intermediate post receptor 134. A top face of cover 140 tapers in a curvilinear fashion to the sides of the cover 140.

Figure 11A:
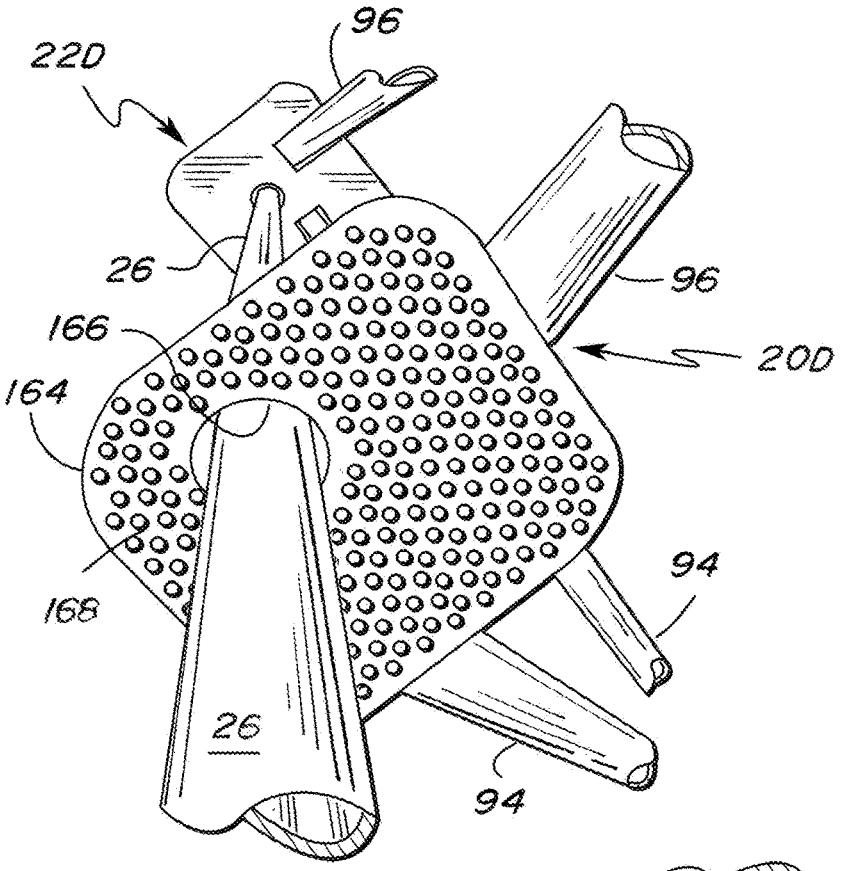
FIG. 11A is a top perspective detail view of a corner upper hub of the bassinet apparatus of FIG. 1.

FIG. 11A shows a top view of upper corner hub 20D. Upper corner hub 20D has a ceiling or base 164. Base 164 includes a through opening 166 for corner post 26. The upper surface 168 of base 164 includes an array of nubs for providing a nonslip surface or surface that minimizes slipping between upper corner hub 20D and the underside of the floor 18 of receptacle 12. Base 164 includes four sides and four rounded corners. Upper corner hubs 20A, 20C, 20D, and 20F have the same features though such features are not arranged identically.

Figure 11B:
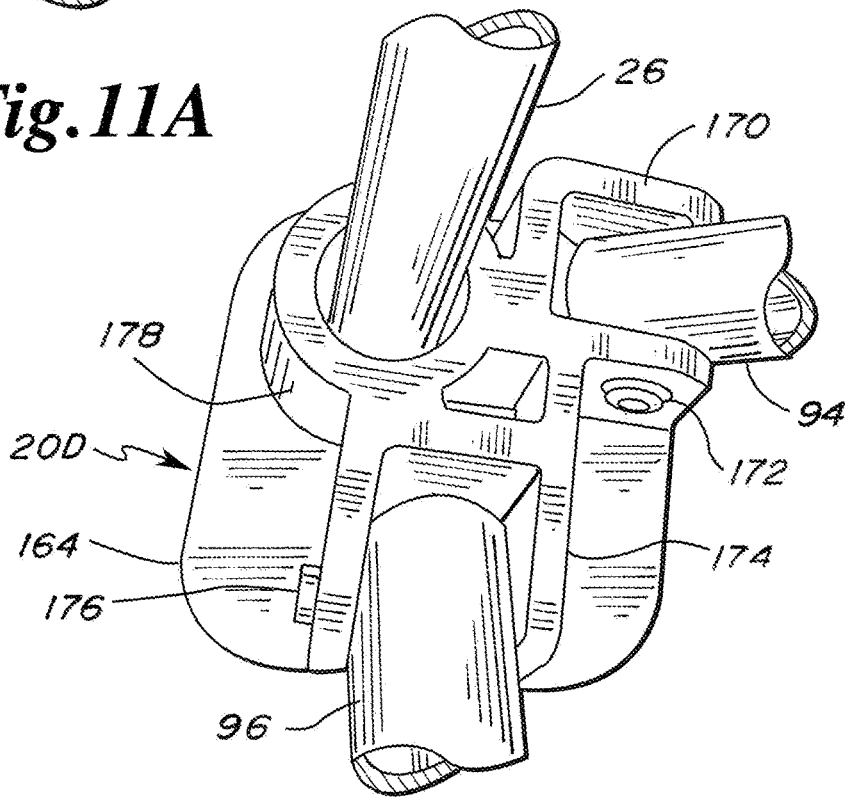
FIG. 11B is a bottom perspective detail view of the corner upper hub of FIG. 11A.

FIG. 11B shows the underside of the upper corner hub 20D. Upper corner hub 20D includes a first receptor 170 for pivotally engaging side oblique support member 94. First receptor 170 is U-shaped or C-shaped. A pivot pin connector 172 engages two sidewalls of receptor 170 and further engages side oblique support member 94. Upper corner hub 20D includes a second receptor 174 for pivotally engaging end oblique support member 96. Second receptor 174 is U-shaped or C-shaped. A pivot pin connector 176 engages two sidewalls of receptor 174 and further engages end oblique support member 96. A third receptor 178 is cylindrical and slidingly receives corner post 26. Receptors 170, 174, 178 are one-piece and integral with base 164. One wall of receptor 174 extends so as to form a bridge to receptor 178. Another wall of receptor 174 extends so as to form a bridge to receptor 170. Rear walls of receptors 170, 174 bridge or extend to form a bridge or connection with cylindrical receptor 178.

Figure 12A:
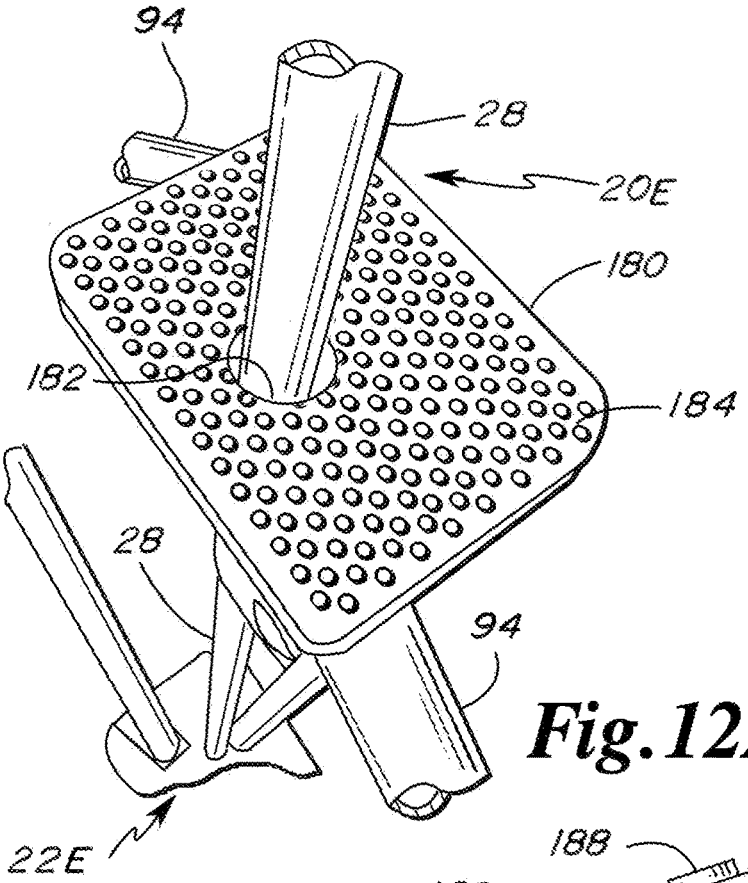
FIG. 12A is a top perspective detail view of an intermediate upper hub of the bassinet apparatus of FIG. 1.

FIG. 12A shows a top view of upper intermediate hub 20E. Upper intermediate hub 20E has a ceiling or base 180. Base 180 includes a through opening 182 for intermediate post 28. The upper surface 184 of base 180 includes an array of nubs for providing a nonslip surface or surface that minimizes slipping between upper intermediate hub 20E and the underside of the floor 18 of receptacle 12. Base 180 includes four sides and four rounded corners. Upper intermediate hubs 20B, 20E have the same features though such features are not arranged identically.

Figure 12B:
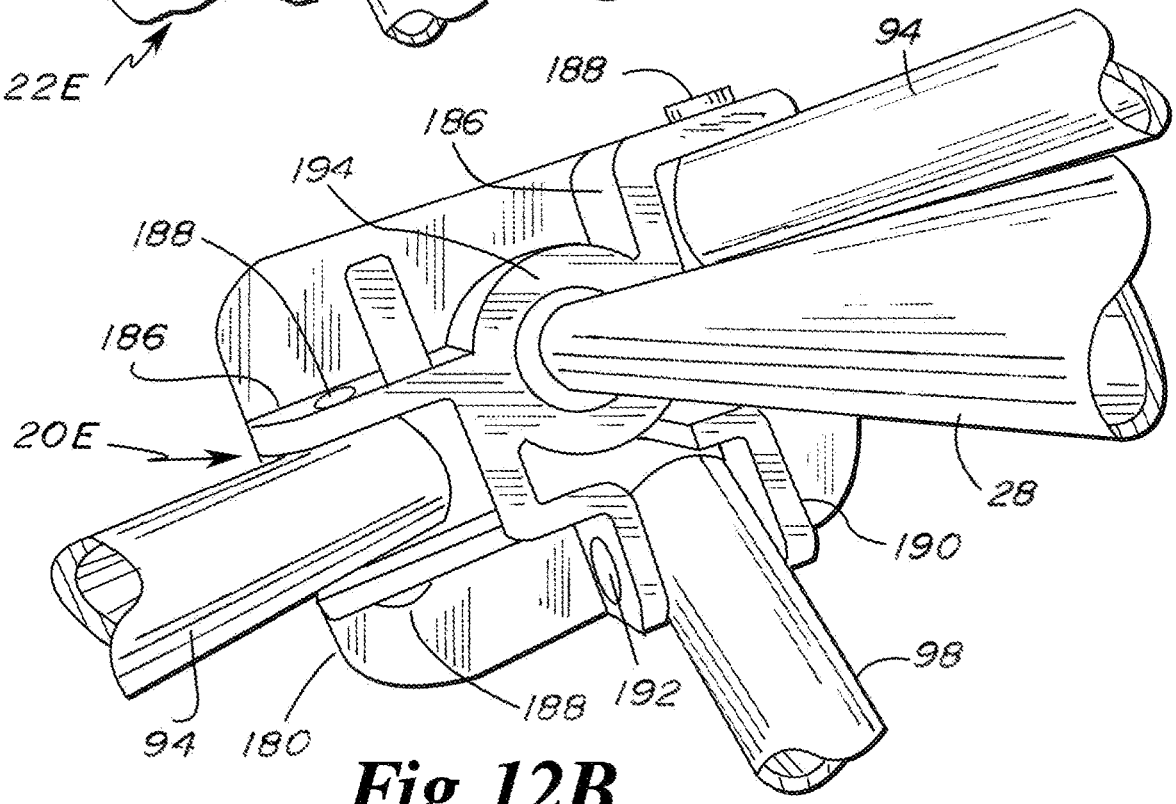
FIG. 12B is a bottom perspective detail view of the intermediate upper hub of FIG. 12A.

FIG. 12B shows the underside of the upper intermediate hub 20E. Upper intermediate hub 20E includes first and second receptors 186 for pivotally engaging side oblique support members 94. First and second receptors 186 are U-shaped or C-shaped. A pivot pin connector 188 engages two sidewalls of each of receptors 186 and further engages side oblique support member 94. Each of the upper intermediate hubs 20B and 20E includes a third receptor 190 for pivotally engaging interior oblique support member 98. Third receptor 190 includes a first plate like sidewall and a second sidewall that is L-shaped. A pivot pin connector 192 engages the two sidewalls of receptor 190 and further engages interior oblique support member 98. A fourth receptor 194 is cylindrical and slidingly receives intermediate post 28. Receptors 186, 190, 194 are one-piece and integral with base 180. One sidewall and the end wall of each of the receptors 186 bridge with cylindrical receptor 194. One sidewall of one receptor 186 extends to form a connection or bridge with the plate like sidewall of receptor 190. The L-shaped sidewall of receptor 190 extends to form a connection or bridge with its adjacent receptor 186.

Figure 14A:
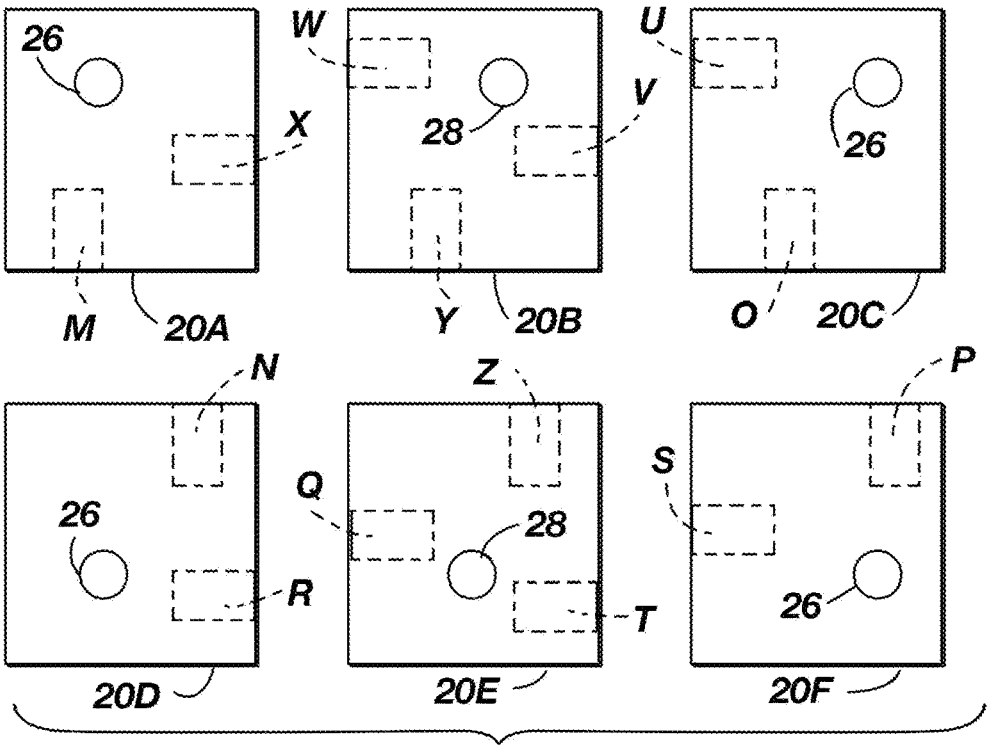
FIG. 14A is a top diagrammatic view of the upper hubs of the bassinet apparatus of FIG. 1.
Figure 14B:
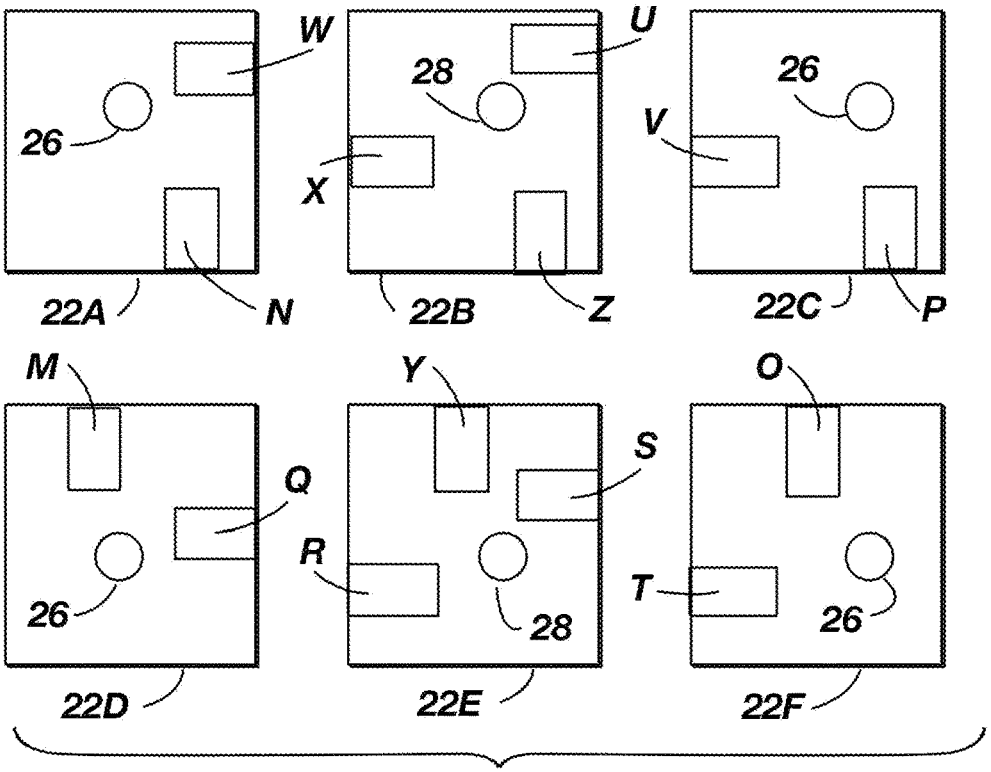
FIG. 14B is a top diagrammatic view of the lower hubs of the bassinet apparatus of FIG. 1.

FIGS. 14A and 14B show diagrammatic views of the upper and lower hubs 20A-F, 22A-F. FIG. 14A is a top view of the upper hubs 20A-F, specifically upper hubs 20A, 20B, 20C, 20D, 20E, and 20F. FIG. 14B is a top view of the lower hubs 22A-F, specifically lower hubs 22A, 22B, 22C, 22D, 22E, and 22F.

In FIGS. 14A and 14B, the receivers or receptors in the upper and lower hubs 20A-F, 22A-F for the support members 94, 96, and 98 are labeled M, N, O, P, Q, R, S, T, U, V, X, Y, and Z. The receptors or receivers on the upper hubs 20A-F are shown in dashed lines in FIG. 14A because the view is from above the upper hubs 20A-F.

Receptors M are found on upper hub 20A and lower hub 22D. Receptors M are outer receptors for an outer end oblique support member 96. "Outer" means closer to an outside of the bassinet apparatus 10 than to an inside of the bassinet apparatus 10.

Receptors N are found on upper hub 20D and lower hub 22A. Receptors N are inner receptors for an inner end oblique support member 96. "Inner" means closer to an inside of the bassinet apparatus 10 than to an outside of the bassinet apparatus 10.

The outer and inner end oblique support members 96 that engage receptors M and N are pivotally engaged to each other at intermediate locations between their ends that are engaged in receptors M and N.

Receptors O are found on upper hub 20C and lower hub 22F. Receptors O are inner receptors for an inner end oblique support member 96.

Receptors P are found on upper hub 20F and lower hub 22C. Receptors P are outer receptors for an outer end oblique support member 96.

The outer and inner end oblique support members 96 that engage receptors O and P are pivotally engaged to each other at intermediate locations between their ends that are engaged in receptors O and P.

Receptors Q are found on upper hub 20E and lower hub 22D. Receptors Q are inner receptors for an inner side oblique support member 94.

Receptors R are found on upper hub 20D and lower hub 22E. Receptors R are outer receptors for an outer side oblique support member 94.

The outer and inner side oblique support members 94 that engage receptors Q and R are pivotally engaged to each other at intermediate locations between their ends that are engaged in receptors Q and R.

Receptors S are found on upper hub 20F and lower hub 22E. Receptors S are inner receptors for an inner side oblique support member 94.

Receptors T are found on upper hub 20E and lower hub 22F. Receptors T are outer receptors for an outer side oblique support member 94.

The outer and inner side oblique support members 94 that engage receptors S and T are pivotally engaged to each other at intermediate locations between their ends that are engaged in receptors S and T.

Receptors U are found on upper hub 20C and lower hub 22B. Receptors U are outer receptors for an outer side oblique support member 94.

Receptors V are found on upper hub 20B and lower hub 22C. Receptors V are inner receptors for an inner side oblique support member 94.

The outer and inner side oblique support members 94 that engage receptors U and V are pivotally engaged to each other at intermediate locations between their ends that are engaged in receptors U and V.

Receptors W are found on upper hub 20B and lower hub 22A. Receptors W are outer receptors for an outer side oblique support member 94.

Receptors X are found on upper hub 20A and lower hub 22B. Receptors X are inner receptors for an inner side oblique support member 94.

The outer and inner side oblique support members 94 that engage receptors W and X are pivotally engaged to each other at intermediate locations between their ends that are engaged in receptors W and X.

Receptors Y are found on upper hub 20B and lower hub 22E. Receptors Y are receptors for an interior oblique support member 98.

Receptors Z are found on upper hub 20E and lower hub 22B. Receptors Z are receptors for an interior oblique support member 98.

The interior oblique support members 98 that engage receptors Y and Z are pivotally engaged to each other at intermediate locations between their ends that are engaged in receptors Y and Z.

Each of the ends of each of the support members 94, 96, 98 are pivotally engaged in one of the upper or lower hubs 20A-F, 22A-F. Crossing support members 94 or 96 or 98 are pivotally engaged to each other at intermediate locations by pivot pin 95. Corner and intermediate posts 26, 28 are fixedly engaged in their respective lower hubs 22A-F and slidingly engage their respective upper hubs 20A-F.

Figure 2:
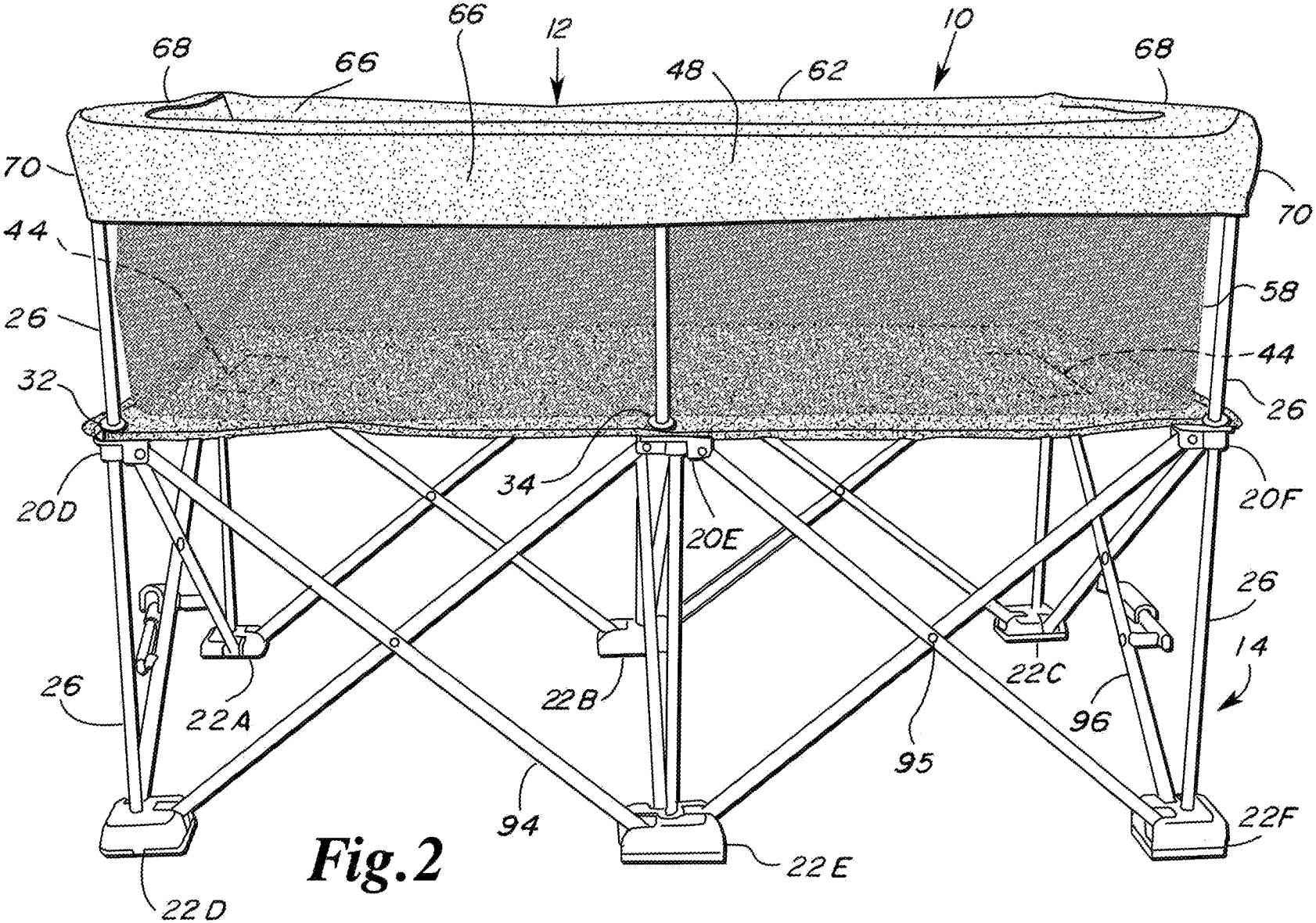
FIG. 2 is a side perspective view of the bassinet apparatus of FIG. 1.
Figure 3:
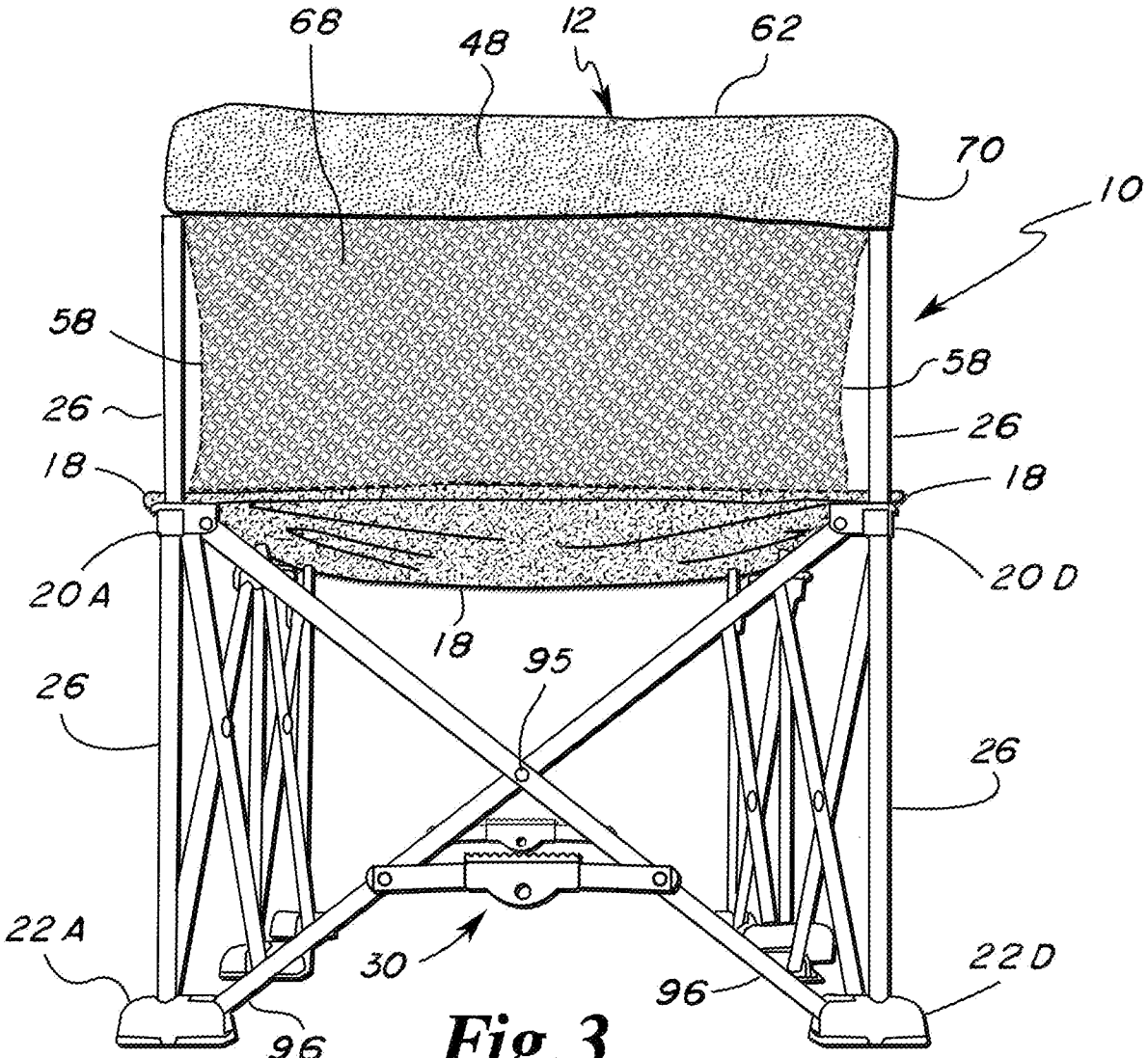
FIG. 3 is an end perspective view of the bassinet apparatus of FIG. 1.

As shown in FIG. 2, FIG. 3, and FIG. 4, the lower hubs 22A-F have a greater footprint than do the upper hubs 20A-F. In other words, the bottoms of the lower hubs 22A-F have a greater amount of surface area than do the tops of the upper hubs 20A-F. Further, the perimeters of the lower hubs 22A-F are greater than the perimeters of the upper hubs 20A-F.

Such a greater foot print or surface area or perimeter is also illustrated by comparing the diameter of the support members in FIGS. 9A, 9C, 10A, 10C (all of which show support members and lower hubs 22A-F) with the diameter of the support members in FIGS. 11B and 12B (all of which show support members and upper hubs 20A-F). The support members 94, 96, 98 have identical diameters and further have a same and unchanging diameter from end to end.

FIGS. 14A and 14B are diagrammatic only and do not represent relative sizes of the upper and lower hubs 20A-F, 22A-F.

Bassinet apparatus 10 includes two over center locks 30. One over center lock 30 is on one end of the scissoring leg arrangement 14. The other over center lock 30 is on the other end of the scissoring leg arrangement 14. Each of the over center locks 30 is engaged to two crossing end oblique support members 96 below the pivoting point where the end oblique support members 96 cross.

Over center lock 30 includes a pusher piece 196, a first member 198, and a second member 200. The inner ends of first and second members 198, 200 are engaged by a pivot pin 202. Pivot pin 202 further engages pusher piece 196. The outer end of first member 198 is engaged to one end oblique support member 96 by a pivot pin 204. The outer end of second member 200 is engaged to the other end oblique support member 96 by a pivot pin 206. When pusher piece 196 is driven down from a position where the scissoring leg arrangement 14 is closed and compact, the rigid members 198, 200 are driven from an inverted or upside down V position shown in FIG. 13B, to a position "just short of a center position" where the expansion of the crossing end oblique support members 96 is just short of being resisted by the folded out state of the floor 18, to a center position where the expansion of the crossing end oblique support members 96 is resisted by the folded out state of the floor 18, and finally to the over-center position opposite of the "just short of a center position." At the over-center position, it takes manual force to reverse the process, to overcome the resistance provided by the folded out state of the floor 18 that resists expansion such as by the upper ends of the end oblique support members 96 being driven apart. Such upper ends of the oblique support members 96 are driven apart when a foot pulls up on the over-center lock 30 at a position just under pivot pin 202 to force the rigid members 198, 200 from a slightly upright V-shaped position, to the center position where the main bodies of the members 198, 200 are aligned on a straight axis, to the "just short of a center position" where the over-center lock 30 is unlocked and where the scissoring leg arrangement 14 can be scissored in or folded in to the closed and compact position shown in FIG. 5.

Pusher piece 196 is formed in the shape of a U-channel. Pusher piece 196 may be operated by hand or by foot, and includes a roughened upper surface, having an array of nubs, to provide a nonslip grip or a grip that minimizes a slip of the hand or a slip of the foot.

The main body of each of first and second members 198, 200 is a tube 208 with a straight axis. Rigidly affixed to the main body 208 of each of the members 198, 200 is a plate like piece 210 having an inner end 212 having a frustoconical shape. Pivot pin 202 engages the inner ends 212, which inner ends 212, because of the frustoconical shape, have some friction with each other, though such friction is minimal such that it takes average adult strength to lock and unlock the over-center lock 30.

Disposed between the outer end of first member 198 and the end oblique support member 96 to which it is pivotally connected is a piece of tubing 214. Disposed between the outer end of second member 200 and the end oblique support member 96 to which it is pivotally connected is a piece of tubing 216. Tubing 214, 216 function in the nature of spacers. Tubing 214 is of a different length than is tubing 216 because one end oblique support member 96 is an outer end oblique support member 96 and the other end oblique support member 96 is an inner end oblique support member 96.

Pad 46 includes three pad sections 218, 220, 222. Pad sections 218, 222 are end pad sections. Pad section 220 is a middle pad section. Pad section 218 is hingedly engaged to pad section 220, which is in turn hingedly engaged to pad section 222. This hinged connection is operative after rigid tubes 224 are removed from pocket sections 226, 228, 230.

Each of the pad sections 218, 220, 222 has its own respective separate interior cushions 232, 234, 236 formed of a resilient material such as a closed cell foam or open cell foam. Sheeting 238 covers the cushions 232, 234, and 236 and it is this sheeting that provides for the hinged engagement. Sheeting 238 is flexible and covers the six faces of each of the cushions 232, 234, and 236.

The bottoms of outer pad sections 218, 222 have a strip 240 of Velcro® material, which is a quick connect material having one of macroscopic loops or hooks. Each of the strips 240 removably engages one of the quick connect strips 44 engaged to the upper side of floor 18.

Pad section 218 includes two pocket sections 226. Each of the pocket sections 226 includes an open end and a closed end.

Pad section 220 includes two pocket sections 228. Each of the pocket sections 228 includes two open ends.

Pad section 222 includes two pocket sections 230. Each of the pocket sections 230 includes an open end and a closeable end. The closeable end is closed by a flap 242 that closes off an otherwise open end of pocket section 230. The underside of flap 242 may have a quick connect material such as Velcro® and the associated end of pocket section 230 may have a quick connect material such as Velcro®.

Flap 242 is opened. Then tube 224 is inserted into the closeable end. Then tube 224 is slid further into pocket section 230, out of pocket section 230, into pocket section 228, out of pocket section 228, into pocket section 226, and further into pocket section 226 until the distal end of tube 224 confronts or becomes adjacent to the closed end of pocket section 226. Then pad assembly 46 may be engaged to the floor 18.

Figure 7B:
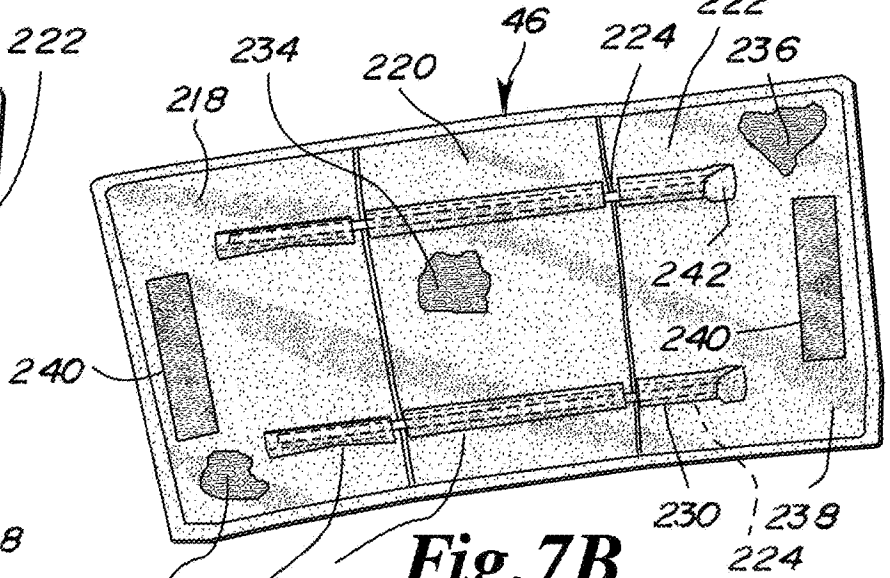
FIG. 7B is a top isolated view of the foldable hinged pad of FIG. 7A showing that pad in its operating form where the three pad sections are held in a common plane by two rigid support members.
Figure 7D:
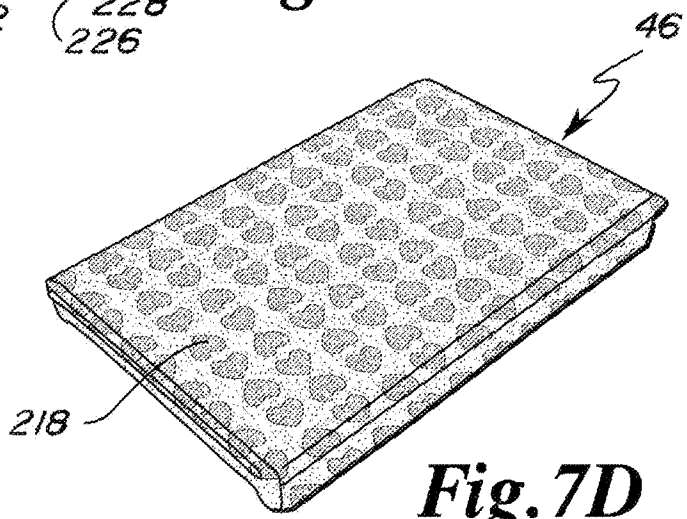
FIG. 7D is a perspective view of the pad of FIG. 7C in a folded compact state where the three pad sections are parallel to each other and the outer pad sections are adjacent to one other pad section and where the middle pad section is adjacent to the outer pad sections.

To place the pad assembly 46 into a folded form for storage as shown in FIG. 7D, the tubes 224 are removed and pad section 218 is folded over to lie on pad section 220. Then pad section 222 is folded to the other face of pad section 220 such that, in the folded and compact state of the pad assembly 46, pad section 220 is disposed between pad sections 218 and 222.

FIG. 1 shows that the mesh section 38 is engaged to the floor 18 at a rectangular location. This rectangular location is spaced from the periphery 37 of the floor 18, which periphery is also rectangular. This spacing, between where the mesh section 38 is engaged to the floor 18 and the periphery 37 of the floor 18, is where the double layer 35 is disposed. At its inner edge, the double layer 35 engages the mesh section 38. Corner posts 26 and intermediate posts 28 engage this spacing or double layer 35. Mesh section 38 is disposed inwardly of the corner posts 26 and intermediate posts 28.

FIG. 1 shows that the endless pocket 48 is formed of a non-see through material. The material is flexible fabric, or flexible sheeting, or a flexible textile. Endless pocket 48 includes the inner wall 50 and the outer wall 52. The height of the inner and outer walls 50, 52 are the same. FIG. 1 thus has an endless band 48 of non-see through material consisting of the endless pocket 48 and an endless band 38 consisting of the mesh section 38.

Each of the top ends of the corner and intermediate posts 26, 28 includes the stop 82. Stop or structure 82 may also be referred to as a support or a sidewall support or platform or base or hanger for the endless pocket 48. Endless pocket 48 depends from structure 82. Sidewall support 82 is the support for the flexible or soft components of the bassinet apparatus 10, i.e., the flexible receptacle 12 that includes the flexible endless pocket 48, the flexible mesh section 38, and the flexible floor 18, all of which depend from the sidewall support 82. Endless pocket 48 rides upon or depends from the six supports 82 of the corner and intermediate posts 26, 28. Mesh section 38 depends from the inner wall 50 of the endless pocket 48. Floor 18 depends from the mesh section 38. Floor 18 supports the pad assembly 46. The pad assembly 46 supports the small child in the bassinet apparatus 10. To some extent the upper hubs 20A-F support the floor 18 and thus the receptacle 12 as a whole.

FIG. 2 shows that: 1) an outer side oblique support member 94 has an opposing side oblique support member 94 on the other side of the bassinet apparatus 10 to which it is parallel, and this opposing side oblique support member is an inner side oblique support member 94, and 2) an outer end oblique support member 96 has an opposing end oblique support member 96 on the other end of the bassinet apparatus 10 to which it is parallel, and this opposing end oblique support member is an inner end oblique support member.

FIG. 3 shows that the end oblique support members 96 are parallel to the interior oblique support members 98. Interior oblique support members 98 and the other end oblique support members 96 are hidden behind the end oblique support members 96 extending between hubs 20A, 20D, 22A, and 22D.

FIG. 4 shows that, when the bassinet apparatus 10 is turned upside down, the floor 18 slides downward on the corner and intermediate posts 26, 28 under the influence of gravity. In other words, there are preferably no fasteners between the upper hubs 20A-F and the floor 18. When the floor 18 slides downwardly, the floor 18 compresses or packs down or scrunches down the mesh section 38 and inner and outer walls 50, 52. The inner and outer elastic strips 78, 80 are fixed to the inner and outer walls 50, 52 and permit the inner and outer walls 50, 52 to slide down the corner and intermediate posts 26, 28 as the bassinet apparatus 10 is turned over and as the floor 18 slides down. In other words, the floor 18 can be slid or lifted upwardly, the inner and outer walls 50, 52 can also be slid upwardly, and then the elastic strips 78, 80 can be stretched such that the elastic strips 78, 80 can be slid over the stops 82, which stops 82 double as the sidewall supports 82. When the elastic strips 78, 80 are disengaged from their respective corner and intermediate posts 26, 28, the bassinet apparatus 10 assumes the form shown in FIG. 6.

Figure 5:
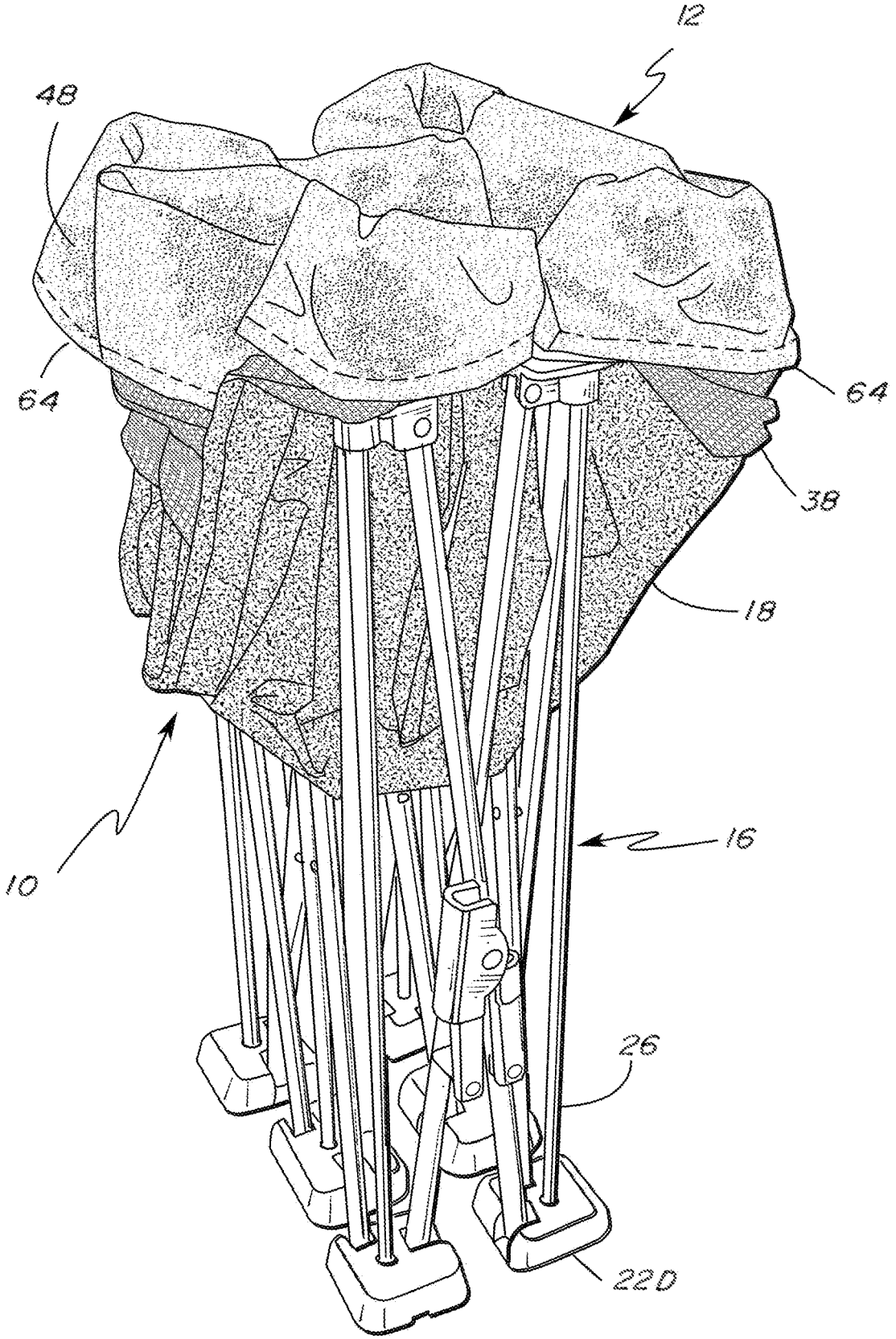
FIG. 5 is a perspective view of a collapsed or folded or scissored in form of the bassinet apparatus of FIG. 1.

FIG. 5 shows that, in the collapsed and compact form, the upper hubs 20A-F are adjacent to each other and the lower hubs 22A-F are adjacent to each other. FIG. 5 shows that the endless pocket 48 and its inner and outer walls 50, 52 are flexible. FIG. 5 shows that the mesh section 38 is flexible. FIG. 5 shows that the floor 18 is flexible. FIG. 5 shows that, in the collapsed and compact form, each of the over-center locks 30 assumes the shape of an inverted or upside down V. FIG. 5 shows that, in the collapsed and compact form, the bassinet apparatus 10 can stand alone in an upright position by itself. FIG. 5 shows that the upper hubs 20A-F push the floor 18 upwardly, which pushes the mesh section 38 upwardly and which further pushes the bottom portions of the endless pocket 48 upwardly, especially those bottom portions of the endless pocket 48 that are adjacent to the posts 26 and 28. Elastic strips 78, 80 are also pushed or slid upwardly toward posts 82 at this time. FIG. 5 shows that the kitty corners or catty corners of the flexible receptacle 12, that are disposed obliquely of the other, are drawn toward each other laterally and longitudinally by obliquely disposed corner posts 26 when the scissoring leg arrangement 12 is folded in from the open and expanded form to the closed and collapsed form. FIG. 5 also shows the height of the endless sidewall 16 is decreased, when the scissoring leg arrangement 12 is folded in, by the upper hubs 20A-F sliding up the posts 26, 28. Such sidewall height increases when the scissoring leg arrangement 12 is folded out. Sidewall 16 includes mesh section 38. Sidewall 16 further includes inner and outer walls 50, 52 of the endless pocket 48.

FIG. 6 shows that the endless pocket 48 can be removed from the corner and intermediate posts 26, 28. FIG. 6 shows the platform that is formed by the tops of the sidewall supports 82. Endless pocket 48 depends from such platform. It should be noted that stops 82 can be adapted to be removably engaged to the tops of the corner and intermediate posts 26, 28 so that the floor 18 can also be slid off the top of the corner and intermediate posts 26, 28. However, it is preferable that the stops 82 are engaged permanently to the posts 26, 28 such that such stops 82 are removable only by destroying a structural integrity of either the stop 82 or posts 26, 28. Stops 82 have a bottom that is greater in size than the diameter of grommets 32, 34 to prevent the floor 18 from being pulled or slid of posts 26, 28.

Figure 7A:
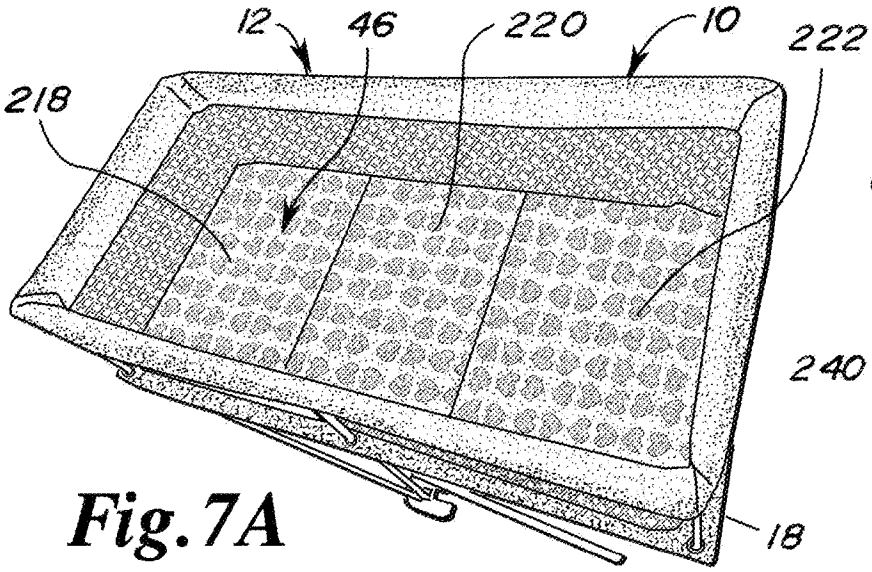
FIG. 7A is a top perspective view of the bassinet apparatus of FIG. 1 having a foldable hinged pad on the floor or bottom of the bassinet.
Figure 7C:
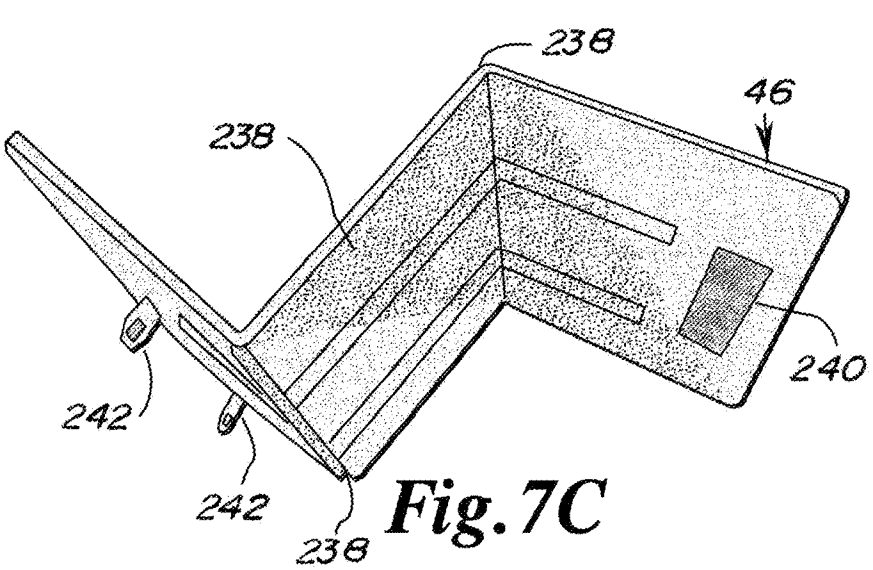
FIG. 7C is a side perspective isolated view of the pad of FIG. 7B in a transitional state where the pad is being folded.

FIG. 7A shows the perimeter of the pad assembly 46, when in the receptacle 12, is adjacent to the inside of the mesh section 38. FIG. 7A shows that a small child can see out of the bassinet receptacle 10, through the mesh section 38, and out of the open top of the bassinet apparatus 10, when on its back on the pass assembly 46. When in the receptacle 12, pad assembly 46 includes the rigid tubes 224 shown in FIG. 7B. FIG. 7C shows the pad assembly 46 in the process of being folded, where the sheeting 238 provides the containment for the cushion material 232, 234, 236 and also provides the hinge between pad sections 218, 220, 222. FIG. 7D shows the compact form of the pad assembly 46.

Figure 8B:
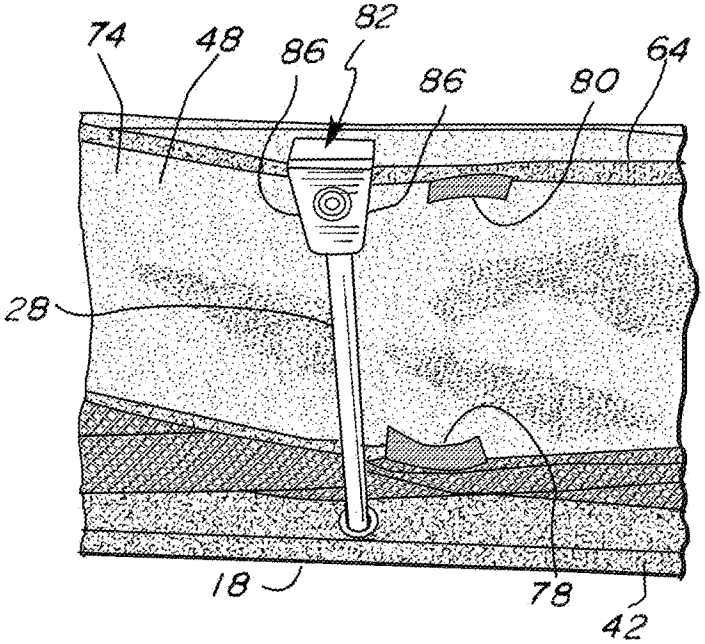
FIG. 8B is a detail view of the upper portion of an intermediate post and the interior of the endless sidewall that captures the intermediate post.
Figure 8A:
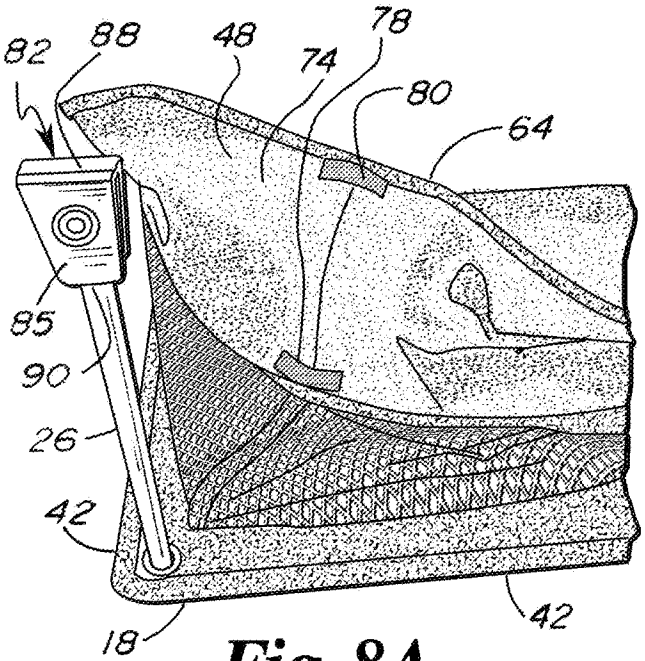
FIG. 8A is a detail view of the upper portion of a corner post and the interior of the endless sidewall that captures the corner post.

FIGS. 8A, 8B, and 8C show detail views of the sidewall support 82 or stop 82 in relation to the inner and outer elastic strips 78, 80 that slidingly engage the corner and intermediate posts 26, 28. FIG. 8A shows that each of the elastic strips 78, 80 that are disposed at the corner of the receptacle 12 extend from a side of the endless pocket 48, about the corner of the endless pocket 48, and to an end of the endless pocket 48. FIGS. 8A, 8B, and 8C show that elastic strip or holder 80 is disposed at the bottom of outer wall 52 and that elastic strip or holder 78 is disposed at the bottom of inner wall 50. Outer wall 52 has free edge 64. Elastic strip or holder 80 is adjacent to free edge 64.

Figure 9C:
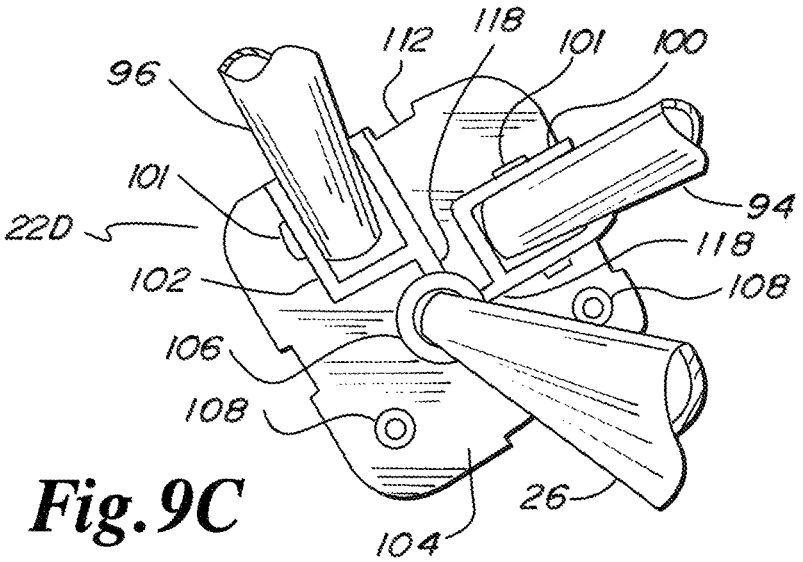
FIG. 9C is a top perspective detail view of the corner lower hub of FIG. 9A with the cover of such hub removed.

FIG. 9A shows the cover 110 for lower hub 22D. Each of the lower hubs 22A, 22B, 22C, 22D, 22E, and 22F has a like cover. FIG. 9B shows the base 104 for lower hub 22D. Each of the lower hubs 22A, 22B, 22C, 22D, 22E, and 22F has a base or floor 104. Base 104 is engagable to cover 110 through pin connector 116. Each of the lower hubs 22A, 22B, 22C, 22D, 22E, and 22F has a base 104 engagable to a cover 110 by a pin connector 116. Each of the covers 110 of each of the lower hubs 22A-F includes an opening 126 for one of the posts 26, 28. Each of the covers 110 includes openings for at least one side oblique support member 94. Covers 110 for corners of the bassinet apparatus 10 include one opening for a side oblique support member 94 and an opening for an end oblique support member 96. Covers 110 having an opening for intermediate post 28 include openings for two side oblique support members 94 and an opening for an interior oblique support member 98, and one of such covers 110 is shown in FIG. 10A. FIG. 9C shows base 104 where the cover 110 has been disengaged from the base 104.

FIG. 11A shows that the through opening 166 of upper corner hub 20D is adjacent to and spaced from the outside diameter of corner post 26. All upper hubs 20A-F have through holes for their respective posts 26, 28 where the inside diameter of the through hole is adjacent to and spaced from the outside diameter of the associated post 26, or 28 such that the leg arrangement 14 is quickly and readily collapsible without interference from the upper hubs 20A-F that slide on the posts 26, 28 but also, at the same time, without excessive wobble, such as lateral and longitudinal and oblique wobble, between the upper hubs 20A-F and the posts 26 and 28. FIG. 11B, a view from below upper hub 20D, also shows that such through hole 166 is spaced from and adjacent to corner post 26.

FIGS. 9A, 9C, 10A, 10C, 11B, and 12B show that the side oblique support members 94, the end oblique support members 96, and the interior support members 98 are adjacent to and abut the sidewalls of their respective receptors or receivers in their respective upper and lower hubs 22A-F. This minimizes wobble to the scissoring leg arrangement 14 when it is locked, when it is being folded, and when it is unlocked and in a stand alone form. Such also maximizes a safe and sturdy bassinet apparatus 10 when in its operating position shown in FIG. 1. This also maximizes an easy folding and unfolding with minimal wobble.

Figure 13A:
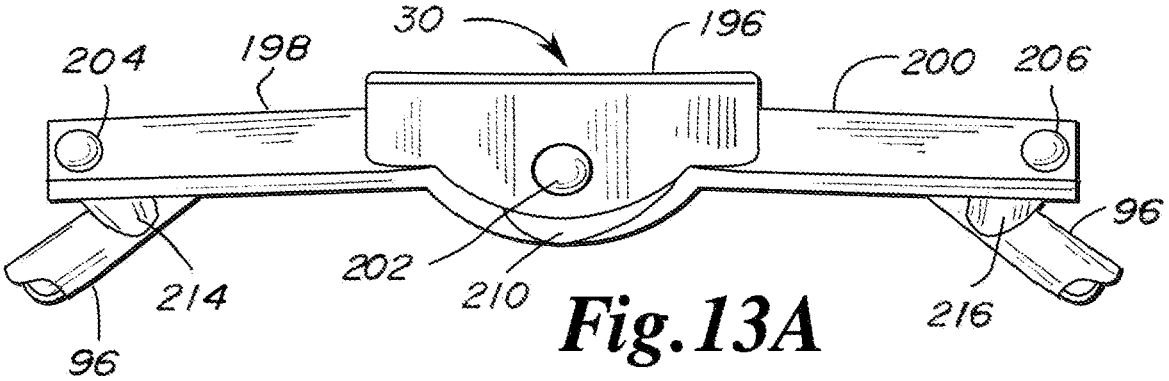
FIG. 13A is a detail side view of the over center lock of the bassinet apparatus of FIG. 1 in a locked position.
Figure 13B:
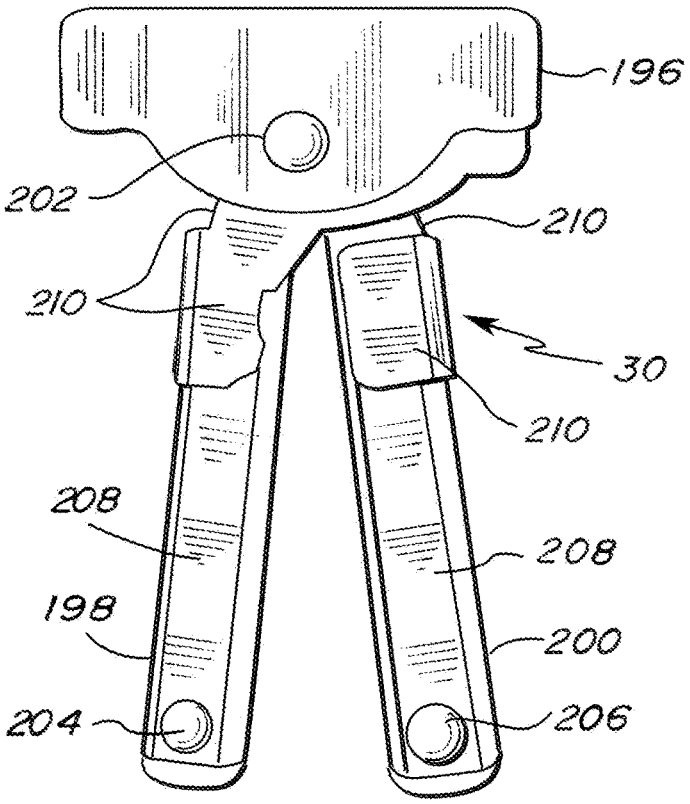
FIG. 13B is a detail side view of the over center lock of FIG. 13A in an unlocked position.
Figure 13C:
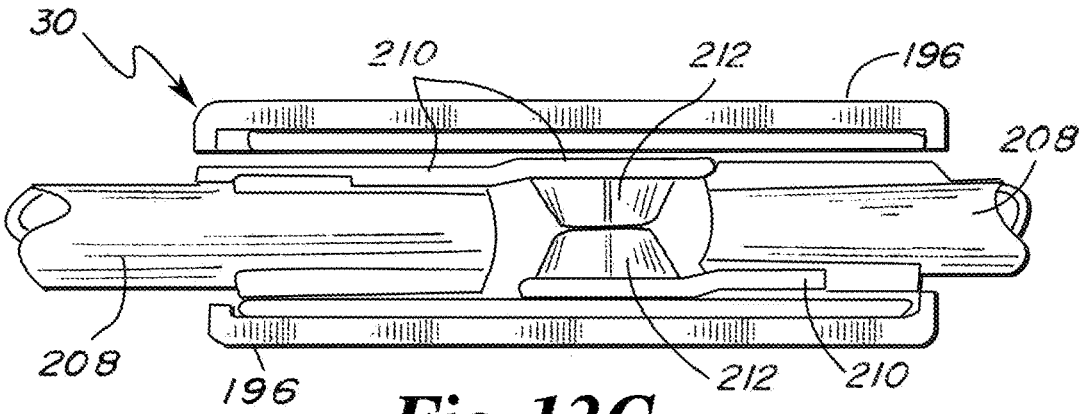
FIG. 13C is a detail bottom view of the over center lock of FIG. 13A in a locked position.

FIG. 13A shows the over-center lock 30 in a locked form. FIG. 13B shows the over-center lock 30 in an unlocked form. FIG. 13C shows the frustoconical portions or ends 212 of the over-center lock 30, which ends 212 provide for minimal friction of the two members 198, 200 against each other, thereby providing for an easy locking and unlocking of the over-center lock 30.

FIGS. 14A and 14B show the relative placement of the side, end, and interior support members 94, 96, and 98.

In operation, from the collapsed and compact form shown in FIG. 5, the scissoring leg arrangement 14 is pulled apart laterally or longitudinally by, for example, pulling apart opposite end portions of the scissoring leg arrangement 14 or pulling apart opposite side portions of the scissoring leg arrangement 14. As the scissoring leg arrangement 14 is pulled apart, the upper hubs 20A-F slide down the corner and intermediate posts 26, 28 and thereby permit decompression of the endless pocket 48 and mesh section 38 that have been pushed up by the floor 18 and upper hubs 20A-F to place the bassinet apparatus 10 in the compact state shown in FIG. 5. As the upper hubs 20A-F and floor 18 slide further down the corner and intermediate posts 26, 28, the endless pocket 48 unfolds and straightens out and the mesh section 38 also unfolds and straightens out. The sidewall 16 (endless pocket 48 and its inner and outer walls 50, 52 and the mesh section 38) may be further unfolded and further straightened out by the hand pulling down on the mesh section 38 and endless pocket 48. Once the endless pocket 48 takes a substantially rectangular form with substantially straight and vertical inner and outer walls 50, 52 and the scissoring leg arrangement 14 resists further manual expansion, the pushers 196 of the over-center locks 30 may be stepped upon to lock the over-center locks 30, whereupon the receptacle 12 is ready for the placement therein of the assembled pad assembly 46, whereupon the bassinet apparatus 10 is ready for the reception therein of a small child.

In operation, when the bassinet apparatus 10 is in the open and operating form shown in FIG. 1, a small child, placed on his or her back, can look out the open top and the see-through mesh section 38. Or, if the small child is placed on his or her stomach, he or she can see through the mesh section 38. A caretaker, sleeping in a bed by the side of the bassinet apparatus 10, can look down through the open top of the bassinet apparatus 10 or can look through the see-through mesh section 38. At night, the bassinet apparatus 10 is sturdy to minimize chances of it being knocked over at night and is locked to minimize chances of the leg arrangement 14 collapsing. In the morning, the small child is easily lifted out of the open top of the receptacle 12. Then the bassinet apparatus 10 is sufficiently light to be slid or carried to another location in its open and locked form. Or the bassinet apparatus 10 can be unlocked, folded in, carried to another room, folded out, and locked in the manner of a minute or less.

In operation, to collapse the bassinet apparatus 10, a foot is placed under the middle of the over-center lock 30, and then the foot is raised to draw the first and second members 198, 200 through over-center. Then opposing ends or opposing sides of the leg arrangement 14 may be pushed together to begin to fold in the leg arrangement 14. As the leg arrangement 14 is folded in, the upper hubs 20A-F push up the floor 18, which pushes up the sidewall 16, where the sidewall 16 includes the mesh section 38 and the endless pocket 48. When the leg arrangement 14 is fully folded in, the upper hubs 20A-F come to a rest at a location spaced from and adjacent to the stops or sidewall supports 82.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A bassinet apparatus comprising:

a) a set of upper hubs;

b) a set of lower hubs;

c) a scissoring leg arrangement between the upper and lower hubs, the scissoring leg arrangement having an open and expanded form, the scissoring leg arrangement having a closed and collapsed form, the scissoring leg arrangement being foldable in from the open and expanded form to the closed and collapsed form, the scissoring leg arrangement being foldable out from the closed and collapsed form to the open and expanded form;

d) a set of corner posts, each of the corner posts engaging one upper hub and one lower hub;

e) a set of intermediate posts, each of the intermediate posts being between two of the corner posts, each of the intermediate posts engaging one upper hub and one lower hub;

f) a flexible receptacle engaged with each of the corner posts and each of the intermediate posts, the flexible receptacle riding on the upper hubs;

g) the flexible receptacle having a flexible floor and an endless flexible sidewall;

h) the floor slidingly engaging each of the corner and intermediate posts and the endless flexible sidewall slidingly engaging each of the corner and intermediate posts such that the flexible receptacle is compressed into a compact form when the scissoring leg arrangement is folded in from the open and expanded form to the closed and collapsed form and such that the flexible receptacle is expanded into an operating form when the scissoring leg arrangement is folded out from the closed and collapsed form to the open and expanded form;

i) wherein the flexible receptacle includes a perimeter, wherein the perimeter of the flexible receptacle includes sides, and wherein the endless flexible sidewall extends along all of said sides of the perimeter of the flexible receptacle;

j) each of the corner posts and intermediate posts having an upper end, said upper end corresponding to one corresponding upper hub disposed directly below said upper end;

k) a distance between said upper end and said one corresponding upper hub upon which the flexible receptacle rides being a first distance when the flexible receptacle is in said operating form;

l) A distance between said upper end and said one corresponding upper hub upon which the flexible receptacle rides being a second distance when the flexible receptacle is in said compact form;

m) wherein said first distance is greater than the second distance; and n) wherein, when the scissoring leg arrangement is folded in from the open and expanded form to the closed and collapsed form, the upper hubs slidingly push the flexible floor toward upper portions of the corner and intermediate posts.

2. The bassinet apparatus of claim 1, wherein the endless flexible sidewall includes an upper endless section and a lower endless section, the upper endless section having an outer layer disposed outwardly of the corner and intermediate posts and an inner layer disposed inwardly of the corner and intermediate posts, the lower endless section comprising an endless mesh portion disposed inwardly of the corner and intermediate posts.

3. The bassinet apparatus of claim 1, wherein the endless flexible sidewall includes an upper endless section that generally forms an upside down U-shape that receives each of the corner and intermediate posts.

4. The bassinet apparatus of claim 3, wherein the upper endless section includes an outer layer facing outwardly relative to the flexible receptacle and an inner layer facing inwardly relative to the flexible receptacle, the outer and inner layers facing opposite directions relative to each other, the corner and intermediate posts being disposed between the outer and inner layers.

5. The bassinet apparatus of claim 4, wherein the outer and inner layers run parallel to each other, wherein the outer and inner layers include lower edges that run adjacent to each other, and wherein the outer and inner layers include upper portions that form an endless upper junction.

6. The bassinet apparatus of claim 1, wherein the flexible receptacle is free of horizontally extending support members that are rigid, and wherein the endless flexible sidewall consists essentially of sheeting.

7. The bassinet apparatus of claim 1, wherein the flexible receptacle engages no horizontally extending support members that are rigid and wherein the flexible receptacle includes no horizontally extending support members that are rigid.

8. The bassinet apparatus of claim 1, wherein, when the flexible receptacle is in the open and expanded form, each of the corner and intermediate posts includes an upper post section extending upwardly beyond the floor of the flexible receptacle, each of the upper post sections engaging adjacent upper post sections with flexible material only extending between said adjacent upper post sections.

9. The bassinet apparatus of claim 1, wherein the endless flexible sidewall includes an endless outer layer with an endless bottom edge section having portions that engage each of the corner and intermediate posts, wherein the endless flexible sidewall includes an endless inner layer with an endless bottom edge section having portions that engage each of the corner and intermediate posts.

10. The bassinet apparatus of claim 1, wherein each of the corner and intermediate posts includes an upper section having an uppermost elongate portion, each of the corner and intermediate posts having a diameter, said uppermost elongate portion having a length greater than said diameter, wherein the endless flexible sidewall includes an upside down pocket engaging said uppermost elongate portion.

11. The bassinet apparatus of claim 10, wherein the upper section includes first and second tapering side edges tapering downwardly from the uppermost elongate portion, the first and second tapering side edges tapering toward each other.

12. The bassinet apparatus of claim 1, wherein the flexible receptacle includes two corners that are disposed obliquely of each other, the two corners being drawn toward each other laterally and longitudinally when the scissoring leg arrangement is folded in from the open and expanded form to the closed and collapsed form.

13. The bassinet apparatus of claim 1, wherein:

a) the flexible floor includes a perimeter;

b) the flexible receptacle includes an endless mesh section that extends upwardly from the flexible floor, the bottom of the endless mesh portion being spaced from the perimeter of the flexible floor;

c) an endless upside down U-shaped section, the endless upside down U-shaped section having an endless outer wall portion and an endless inner wall portion, the endless upside down U-shaped section engaging each of the corner and intermediate posts, the endless outer wall portion being disposed outwardly of the posts, the endless inner wall portion being disposed inwardly of the posts; and d) the endless inner wall portion and endless mesh section engaging each other along an endless junction.

14. The bassinet apparatus of claim 1, and further comprising a pad assembly removably engaged to the flexible floor, a periphery of the pad assembly being adjacent to the endless flexible sidewall of the flexible receptacle, the pad assembly including first, second, and third sections, the first section being hingedly engaged to the second section, the second section being hingedly engaged to the third section, the second section being stackable on the first section such that peripheral edges of the first and second sections are adjacent to each other, the third section being stackable on the second section such that peripheral edges of the second and third sections are adjacent to each other, each of the first, second, and third sections engagable to at least one rigid elongate member such that, when the first, second, and third sections are engaged by said at least one rigid elongate member, the first, second, and third sections are disposed in generally a common plane.

15. The bassinet apparatus of claim 1, wherein the flexible floor folds in when the scissoring leg arrangement folds in and wherein the flexible floor folds out when the scissoring leg arrangement folds out.

16. The bassinet apparatus of claim 1, wherein the endless flexible sidewall includes an upper upside down U-shaped portion having outer and inner walls, the outer wall having an inner face and a bottom edge, the bottom edge of the inner face of the outer wall having portions that slidingly engage each of the corner and intermediate posts, the inner wall having an inner face and a bottom edge, the bottom edge of the inner face of the inner wall having portions that slidingly engage each of the corner and intermediate posts, wherein, when the scissoring leg arrangement is folded in from the open and expanded form to the closed and collapsed form, the upper hubs slidingly push the bottom edges of the outer and inner walls upwardly on the corner and intermediate posts.

17. The bassinet apparatus of claim 1, wherein the endless flexible sidewall includes an endless upside down pocket having an upper portion that is closed and a lower portion that is open, wherein each of the corner and intermediate posts extends into the endless upside down pocket, wherein each of the corner and intermediate posts includes an upper end that is adjacent to the upper portion of the upside down pocket.

18. A bassinet apparatus comprising:

a) a set of upper hubs;

b) a set of lower hubs;

c) a scissoring leg arrangement between the upper and lower hubs, the scissoring leg arrangement having an open and expanded form, the scissoring leg arrangement having a closed and collapsed form, the scissoring leg arrangement being foldable in from the open and expanded form to the closed and collapsed form, the scissoring leg arrangement being foldable out from the closed and collapsed form to the open and expanded form;

d) a set of corner posts, each of the corner posts engaging one upper hub and one lower hub;

e) a flexible receptacle engaged with each of the corner posts, the flexible receptacle riding on the upper hubs;

f) the flexible receptacle having a flexible floor and an endless flexible sidewall;

g) the flexible floor slidingly engaging each of the corner posts and the endless flexible sidewall slidingly engaging each of the corner posts such that the flexible receptacle is folded into a compact form when the scissoring leg arrangement is folded in from the open and expanded form to the closed and collapsed form and such that the flexible receptacle is expanded into an operating form when the scissoring leg arrangement is folded out from the closed and collapsed form to the open and expanded form;

h) wherein the flexible receptacle includes a perimeter, wherein the perimeter of the flexible receptacle includes sides, and wherein the endless flexible sidewall extends along all of said sides of the perimeter of the flexible receptacle;

i) each of the corner posts and intermediate posts having an upper end, said upper end corresponding to one corresponding upper hub disposed directly below said upper end;

j) a distance between said upper end and said one corresponding upper hub upon which the flexible receptacle rides being a first distance when the flexible receptacle is in said operating form;

k) a distance between said upper end and said one corresponding upper hub upon which the flexible receptacle rides being a second distance when the flexible receptacle is in said compact form;

l) wherein said first distance is greater than the second distance; and m) wherein, when the scissoring leg arrangement is folded in from the open and expanded form to the closed and collapsed form, the upper hubs slidingly push the flexible floor toward upper portions of the corner and intermediate posts.

19. A bassinet apparatus comprising:

a) a set of corner posts;

b) a set of intermediate posts, each of the intermediate posts being between two of the corner posts;

c) a flexible receptacle engaged with each of the corner posts and each of the intermediate posts;

d) the flexible receptacle having a floor and an endless flexible sidewall;

e) the floor engaging each of the corner posts and each of the intermediate posts;

f) the endless flexible sidewall engaging each of the corner posts and each of the intermediate posts;

g) the floor including a perimeter;

h) the flexible receptacle including an endless mesh section that extends upwardly from the floor, the bottom of the endless mesh portion being spaced from the perimeter of the floor to define an endless rectangular floor portion;

i) an endless upside down U-shaped section, the endless upside down U-shaped section having an endless outer wall portion and an endless inner wall portion, the endless upside down U-shaped section engaging each of the corner and intermediate posts, the endless outer wall portion being disposed outwardly of the posts, the endless inner wall portion being disposed inwardly of the posts;

j) the endless inner wall portion and endless mesh section engaging each other along an endless junction;

k) wherein the flexible receptacle includes a perimeter, wherein the perimeter of the flexible receptacle includes sides, and wherein the endless flexible sidewall extends along all of said sides of the perimeter of the flexible receptacle; and l) Each of the corner posts and each of the intermediate posts extending through the endless rectangular floor portion; and m) the endless rectangular floor portion opposing the endless upside down U-shaped section such that each of the corner posts and each of the intermediate posts extend from the endless rectangular floor portion into the endless upside down U-shaped section.

* * * * *